US010000314B2

(12) United States Patent
Slack

(10) Patent No.: US 10,000,314 B2
(45) Date of Patent: Jun. 19, 2018

(54) CONTAINER AND METHOD FOR MAKING THE SAME

(75) Inventor: Henry William Slack, London (GB)

(73) Assignee: Frugalpac Limited (GB)

( * ) Notice: Subject to any disclaimer, the term of this patent is extended or adjusted under 35 U.S.C. 154(b) by 352 days.

(21) Appl. No.: 14/232,747

(22) PCT Filed: Jul. 12, 2012

(86) PCT No.: PCT/GB2012/051662

§ 371 (c)(1),
(2), (4) Date: Feb. 27, 2014

(87) PCT Pub. No.: WO2013/008025

PCT Pub. Date: Jan. 17, 2013

(65) Prior Publication Data

US 2014/0209618 A1 Jul. 31, 2014

(30) Foreign Application Priority Data

Jul. 14, 2011 (GB) ..... 1112106.8
Jul. 10, 2012 (GB) ..... 1212264.4

(51) Int. Cl.

| | |
|---|---|
| ***B65D 25/16*** | (2006.01) |
| ***B65D 25/14*** | (2006.01) |
| ***B65D 77/20*** | (2006.01) |
| ***B65D 81/38*** | (2006.01) |
| ***B65D 43/02*** | (2006.01) |
| ***B65D 51/18*** | (2006.01) |
| ***B31B 7/00*** | (2006.01) |

(52) U.S. Cl.

CPC ..... *B65D 25/16* (2013.01); *B31B 7/00* (2013.01); *B65D 25/14* (2013.01);
(Continued)

(58) Field of Classification Search
CPC combination set(s) only.
See application file for complete search history.

(56) References Cited

U.S. PATENT DOCUMENTS 2,542,413 A 2/1951 Ibsch, Jr.
2,685,385 A 8/1954 Kuss
(Continued)

FOREIGN PATENT DOCUMENTS

CA 1125681 6/1982
DE 102005035489 A1 2/2007
(Continued)

OTHER PUBLICATIONS http://www.thefreedictionary.com/cup, Date Unknown.*

*Primary Examiner* — Jeffry H Aftergut
*Assistant Examiner* — Jaeyun Lee
(74) *Attorney, Agent, or Firm* — Hayes Soloway PC

(57) ABSTRACT

A method of making a container (2, 30) having a separable inner lining (6) and outer shell (4) comprises the steps of: forming an outer shell; pre-forming a flexible lining, at least a part of the lining conforming to a complete internal shape of the shell; inserting the preformed lining into the shell so that a first part of the lining is within the shell and a second part of the lining protrudes from the opening of the shell; adhering the first part to an internal surface (8) of the shell; conforming the second part to an external surface of the shell; and attaching to the lining around said rim a sealing layer covering the opening, and the adhesion between the lining and the internal surface of the shell being such that the lining is peelable from the shell while remaining intact.

19 Claims, 17 Drawing Sheets

(52) U.S. Cl.
CPC ..... *B65D 43/0212* (2013.01); *B65D 51/18* (2013.01); *B65D 77/2024* (2013.01); *B65D 81/3874* (2013.01); *B31B 2217/0053* (2013.01); *B31B 2217/0069* (2013.01); *B31B 2217/062* (2013.01); *B31B 2217/064* (2013.01); *B31B 2217/066* (2013.01); *B65D 2251/0018* (2013.01); *B65D 2251/0093* (2013.01); *B65D 2543/0074* (2013.01); *B65D 2543/00092* (2013.01); *B65D 2543/00351* (2013.01); *B65D 2543/00537* (2013.01); *B65D 2543/00638* (2013.01); *B65D 2543/00685* (2013.01); *B65D 2543/00796* (2013.01); *B65D 2577/205* (2013.01); *B65D 2577/2025* (2013.01)

(56) References Cited

U.S. PATENT DOCUMENTS 3,085,375 A 4/1963 Harrison
3,377,766 A * 4/1968 Nelson ..... B29C 63/343 156/287
3,468,468 A * 9/1969 Foote ..... B65D 81/264 220/902
3,790,021 A * 2/1974 Bailey ..... B65D 25/14 220/495.03
4,282,984 A * 8/1981 Curry, Jr. ..... A23B 4/00 206/497
4,982,872 A 1/1991 Avery
5,025,981 A 6/1991 Schellenberg
5,143,242 A * 9/1992 Millasich ..... B44D 3/12 141/65
5,363,980 A * 11/1994 Mulcahy ..... B65F 1/00 206/554
6,505,657 B1 1/2003 Lawrence
2007/0262487 A1 11/2007 O'Hagan et al.
2008/0264937 A1 10/2008 D'Amato
2012/0165170 A1 * 6/2012 Wischusen, III ..... B31B 1/00 493/100
2012/0291712 A1 * 11/2012 Wallace ..... B32B 37/12 119/167

FOREIGN PATENT DOCUMENTS

EP 2314518 A1 4/2011
JP 2005059879 A 3/2005
WO 9950153 A1 10/1999

* cited by examiner

CONTAINER AND METHOD FOR MAKING THE SAME

BACKGROUND a. Field of the Invention

This invention relates to a method of making a container having a separable inner lining and outer shell, the inner layer being adhered to the outer layer such that after use, the inner layer may be peeled away from the outer layer. In particular, this invention relates to a container for a beverage or foodstuff, and to a container for paint or other potentially hazardous liquids.

b. Related Art

There is a general desire and need to reduce the amount of waste that is produced and a drive to recycle as much as possible. One particular area that is receiving much attention is packaging.

One sector of interest is disposable or paper cups. These are often made from pre-laminated card which is then rolled and formed to create a disposable cup. The use of laminated card can have the benefits of being more resource and energy efficient than using plastic alone, however, combining materials in this way makes recycling difficult, and therefore, most disposable cups end up in landfill.

Typically the laminated card comprises a paper-based substrate layer and a polymeric coating, which in the case of disposable cup is usually polyethylene. The coating is waterproof and acts as a liquid barrier between the contents of the cup and the paper-based substrate. Generally, the laminated card has a polymeric or plastics coating on only one side of the substrate when used to form cups to hold hot beverages, whereas the laminated card will often have a plastics coating on both sides of the paper-based substrate when used to form cups to hold cold beverages.

However, these coatings prevent the material from fully decomposing. In particular, during the recycling process typically used for paper products, the plastics coating prevents or inhibits water breaking up the paper fibres of the substrate during the process of pulping. Additionally, the plastics coating is difficult to separate and therefore contaminates the paper pulp that is formed.

Of note is the fact that an estimated 58 billion paper cups end up in landfill every year in the USA, and this equates to several million trees being felled annually, as most of the paper-based material used to form the cups is virgin, non-recycled material.

There is, therefore, a need to find a more environmentally friendly alternative. However, commercial considerations mean that it is desirable for any alternative to be able to be manufactured at similar speeds and in similar volumes to existing paper cups and also with the same degree of reliability and consistency. Current paper cup making machines typically output at a rate of up to 100-200 cups per minute with a failure/leakage rate of about one cup in every million.

A second sector of interest is that of containers for hazardous liquids such as paints and oils. Containers for hazardous liquids are difficult to dispose of in an environmentally safe manner and very few containers are recycled due to contamination by the paint, oil or other similar substance.

Known paint pots and similar containers filled with environmentally hazardous liquids are typically made from a semi-rigid plastics material or from metal. After use, the pot remains contaminated with paint residue or similar and the entire container must be disposed of in a suitable manner depending on the type of hazardous liquid. Often the containers end up in a specialist landfill. However, the cost associated with dealing with these containers means that it is becoming increasingly difficult to dispose of them in a convenient and cost effective way.

It is, therefore an object of the invention to provide a container, and a method of making such a container, that overcomes the above-mentioned problems.

SUMMARY OF THE INVENTION

According to the invention there is provided a method of making a container having a separable inner lining and outer shell, the method comprising the steps of:

- forming an outer shell of the container, the shell being made from a paperboard or plastics material;
- pre-forming a flexible lining from a thin sheet of barrier material, at least a part of the lining conforming to a complete internal shape of the shell;
- inserting the pre-formed lining into the shell so that a first part of the lining is within the shell and a second part of the lining protrudes from an opening of the shell;
- adhering the first part of the lining to an internal surface of the shell; and
- conforming the second part of the lining to an external surface of the shell, wherein the adhesion between the lining and the internal surface of the shell is such that the lining can subsequently be peeled away from the shell, so that the lining remains intact and no lining remains on the shell, to fully separate the inner lining and outer shell of the container.

Preferably the second part of the lining is conformed to the external surface of the shell around the opening.

Preferably the thin sheet of barrier material is a thin film plastics material. However, the thin sheet may be in the form of a film of any other suitable material and may be formed from other suitable polymeric materials such as corn starch. Alternatively the sheet of barrier material may be a metal foil. The thin sheet is preferably made from a non-porous material which does not permit liquids to pass through the lining. The sheet may additionally be impermeable to gases so that the lining acts as a gas barrier.

The lining is typically formed from a thin sheet of plastics material which is folded and bonded to form a bag. The thickness of the material of the pre-formed lining is such that the lining is not self-supporting and, as such, only maintains its required shape when placed over a suitable male former or adhered to the shell.

The term conforming is used to indicate that the pre-formed lining has the same shape as the internal volume of the shell. In some embodiments of the invention, the dimensions of the lining may initially be slightly less than the internal dimensions of the shell, but the dimensions of the lining are preferably greater than 95% of the dimensions of the shell. In this way, the lining is not stretched significantly after insertion into the shell to enable it to be adhered to the shell.

The term fully separated is used to indicate that the lining may be removed from the surface of the shell with the lining remaining intact. Preferably, the lining is cleanly separated from the shell such that none of the material of the shell remains attached to the lining and none of the material of the lining remains attached to the shell. In some embodiments, however, a small amount of shell material may remain attached to the lining, for example when the shell is made from a paperboard material. This amount should be less than 5% of the volume of shell material, and is preferably less than 2% of the volume of shell material.

In some embodiments of the present invention it is advantageous to make the shell from a paperboard material. Paperboard materials are generally easier to recycle than other materials, and paperboard materials generally have good thermal insulation properties.

Preferably once the lining has been inserted into the shell, the second part of the lining is folded over a rim of the opening such that the second part of the lining is adjacent the external surface of the shell.

Typically the step of conforming the second part of the lining to the external surface of the shell comprises heating the second part of the lining such that the second part of the lining shrinks around the outside of the shell. In some embodiments it is advantageous if the method further comprises applying an adhesive to a region of the external surface of the shell around the opening, so that the second part of the lining is adhered to the shell in this region.

Preferably perforations are formed in a portion of the second part of the lining, to enable a user to more easily separate the lining from the shell in this region.

Preferably the step of pre-forming the lining comprises folding a sheet of a thin film plastics material and bonding said sheet along at least one edge. Typically the sheet of a thin film plastics material is bonded along at least one edge to form a bag.

Pre-forming the lining in this way has advantages over previous methods using thermoforming or vacuum forming to create the lining. Firstly, when using thermoforming methods there is typically a limit to the depth a sheet of plastics material can be drawn before the sheet becomes too thin and tears. By forming a lining by folding and bonding a sheet of plastics material, deeper shapes can easily be achieved and the thickness of the plastics sheet remains substantially the same over the whole area of the lining. Secondly, by forming the lining as in the present invention, there is no limitation on the type of plastics material that may be used. In particular, the material is not limited to a thermoplastic material.

Preferably the method step of pre-forming the lining comprises providing a male former, an end portion of the male former having substantially the same dimensions as the internal dimensions of the shell, and conforming at least a part of the lining to the shape of the male former. Preferably the step of conforming a part of the lining to the shape of the male former comprises heating a part of the lining. Typically, the step of heating a part of the lining comprises heating an end portion of the lining to a temperature such that the end of the lining shrinks so as to conform to the shape of an end of the male former. This method step is used, in particular, to form a flat base of the lining bag.

Preferably the step of adhering the lining to an internal surface of the shell comprises applying an adhesive to an external surface of the lining before the lining is inserted into the shell. More preferably the thin sheet of barrier material used to pre-form the lining is pre-coated with an adhesive before forming the lining. In alternative embodiments, the step of adhering the lining to an internal surface of the shell comprises applying an adhesive to the internal surface of the shell before the lining is inserted into the shell.

Preferably the method step of inserting the lining into the shell comprises inserting a male former into the shell, the male former having substantially the same dimensions as the internal dimensions of the shell, so that the lining locates adjacent to and/or is pressed against the internal surfaces of the shell.

The method preferably further comprises applying a partial vacuum between the lining and the shell, when the lining is inserted in the shell, to draw lining towards the internal surface of the shell.

In embodiments in which a male former is used to insert the lining into the shell, it is preferable if the method further comprises the step of blowing the lining away from the male former when the lining is positioned inside the shell. This allows the male former to be made slightly smaller than the internal dimensions of the shell so that the male former and lining do not get caught on the shell as the lining is being inserted. The lining can then be blown outwards away from the male former towards internal surfaces of the shell.

In some embodiments the outer shell is substantially conical or frustoconical. The outer shell may be a non-laminated paper cup. In other embodiments the outer shell may be cylindrical.

Preferably the lining is made from polyethylene. The lining material may comprise ethylene vinyl alcohol (EVOH).

Preferably the method further comprises the step of printing a graphic on the internal surface of the shell. This may be viewable through a clear lining or alternatively, may only be revealed once the lining has been removed from the shell.

Also according to the invention there is provided a container having a separable inner lining and outer shell, wherein the container comprises:

an outer shell made from a paperboard or plastics material; and an inner lining, the lining comprising a pre-formed flexible lining of a thin sheet of barrier material, a first part of the lining conforming to a complete internal shape of the shell and being adhered to an internal surface of the shell by a layer of adhesive, and a second part of the lining being in contact with an external surface of the shell, wherein the adhesive adhering the first part of the lining to the internal surface of the shell is such that the lining is peelable from the shell so that the lining remains intact and no lining remains on the shell, such that the inner lining and outer shell of the container are fully separated.

Preferably the thin sheet of barrier material is non-porous to prevent liquids passing through the lining, and the barrier material may additionally by impermeable to gasses. Preferably the thin sheet of barrier material is a thin film plastics material. More preferably the lining is made of polyethylene. The lining may comprise ethylene vinyl alcohol (EVOH).

The thickness of the plastic sheet is preferably substantially the same over the whole area of the lining. This is achieved by folding and bonding a sheet of plastics material to pre-form a lining bag, rather than thermoforming the lining directly into the shell. Typically, thermoforming or vacuum forming the lining causes the plastics film to stretch and, in particular, to decrease in thickness in deeper drawn regions of the film. Due to a preferred method of pre-forming the lining, the lining may include at least one seam. Preferably the lining is made from an unstretched sheet of plastics material.

In preferred embodiments the thickness of the lining is no more than half the thickness of the shell. More preferably the thickness of the lining is less than 50 μm.

Preferably the outer shell is made from a paperboard material. Paperboard materials are generally easier to recycle than other materials, and paperboard materials generally have good thermal insulation properties.

Preferably the second part of the lining includes perforations to enable a user to more easily separate the lining from the shell in this region.

In some embodiments the outer shell is substantially conical or frustoconical. The outer shell may be a non-laminated paper cup.

Preferably the shell includes a graphic printed on a part of the internal surface of the shell. In some embodiments the graphic may be visible through a clear lining. In other embodiments the lining is preferably opaque, so that, in use, the graphic is revealed when a user of the container peels the lining away from the shell.

In some embodiments the container may further comprise a lid that engages with a rim around an opening of the container.

In some embodiments the container may be a disposable cup. In other embodiments the container may be a paint pot.

BRIEF DESCRIPTION OF THE DRAWINGS

The invention will now by further described, by way of example only, and with reference to the accompanying drawings, in which.

DETAILED DESCRIPTION

Figure 3:
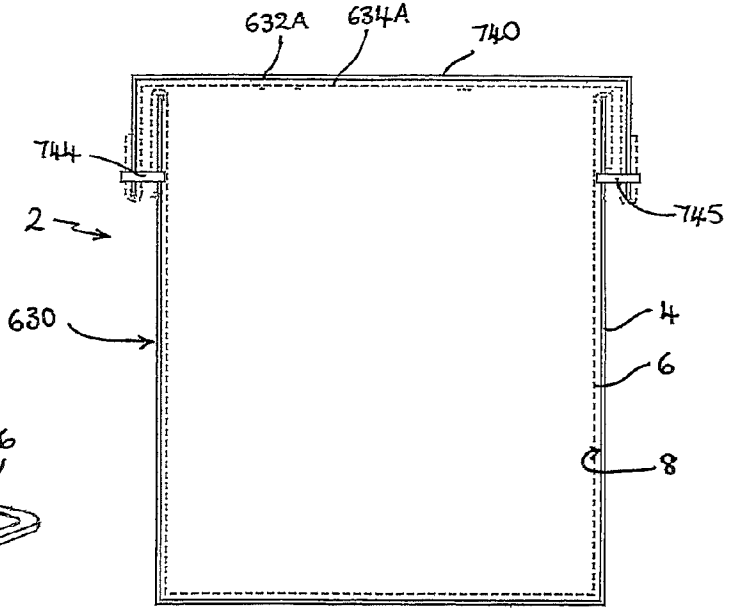
FIG. 3 shows a container with a lid according to a further embodiment of the present invention.
Figure 2:
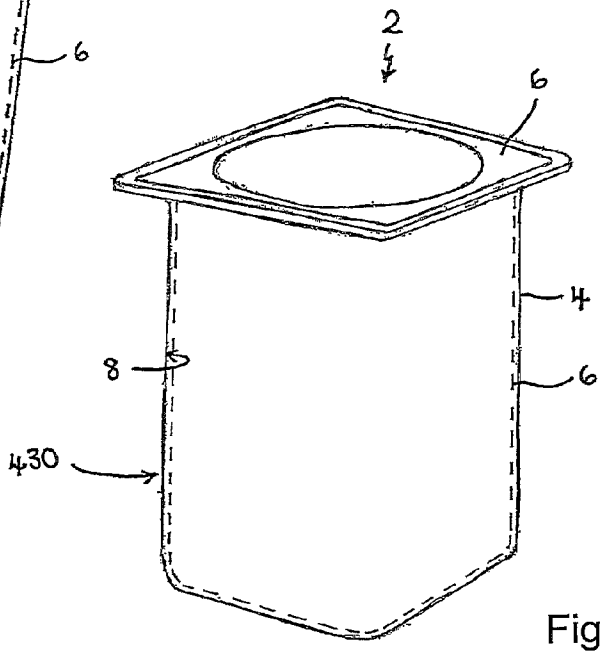
FIG. 2 shows a container in the form of a yogurt pot according to another embodiment of the present invention.
Figure 1:
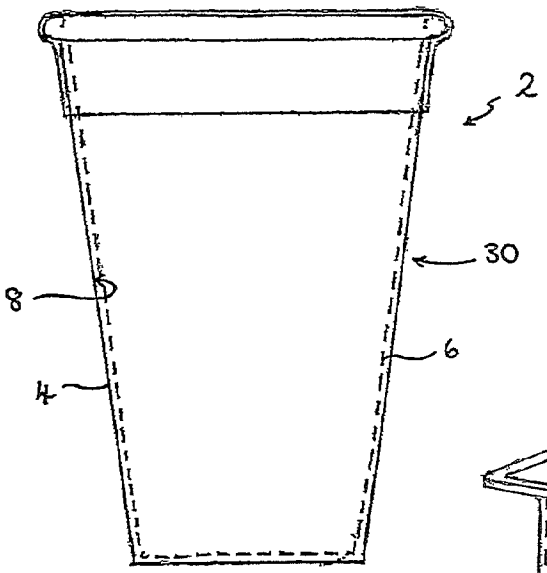
FIG. 1 shows a container in the form of a disposable cup according to an embodiment of the present invention.

FIGS. 1, 2 and 3 show containers 2 according to preferred embodiments of the present invention. In a first example, shown in FIG. 1, the container 2 is in the form of a disposable cup or rolled edge container 30. A second example, shown in FIG. 2, is a container for foodstuffs such as yogurt. In a third example, shown in FIG. 3, the container 2 forms part of a paint pot, which further comprises a lid.

Each of the containers 2 has an outer layer or shell 4 made from cardboard or a similar paper-based material and an inner layer or lining 6 made from a thin-film plastics material. The lining 6 acts as a barrier layer preventing the contents of the container 2 leaking out of the container 2. The barrier properties of the lining 6 may additionally prevent moisture or gasses entering the container 2 which may spoil or degrade the contents of the container 2. The lining 6 is bonded to the internal surfaces 8 of the outer shell 4 by a suitable adhesive such that after use, the lining 6 may be peeled away from the shell 4 and disposed of separately from the shell 4.

A first preferred embodiment in the form of a cup 30 will now be described further with reference to FIGS. 4 to 13.

Figure 4:
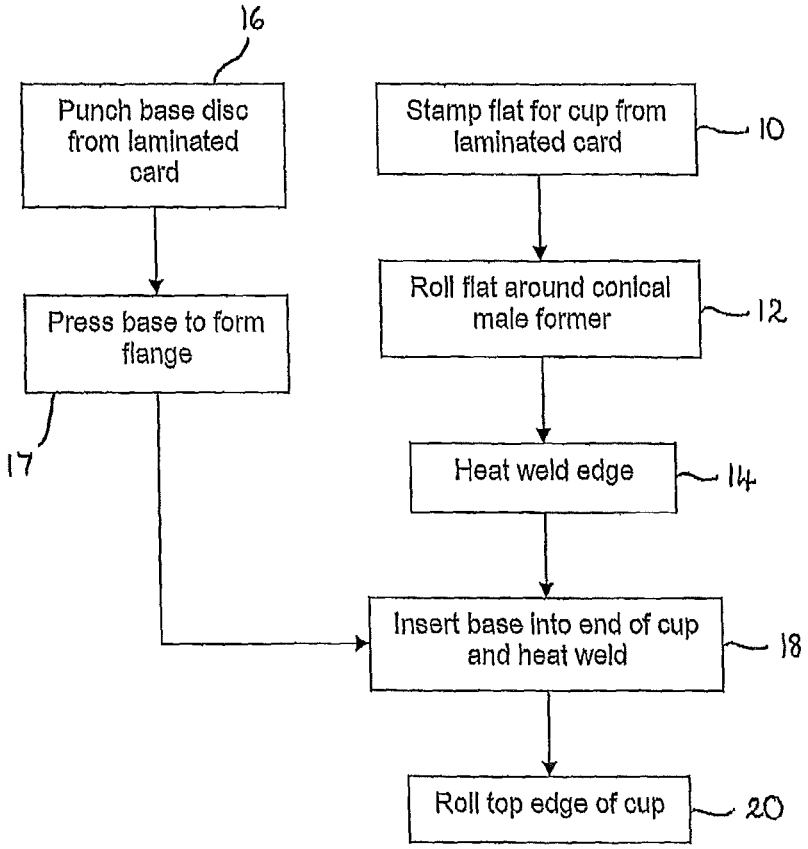
Fig. 4 PRIOR ART
FIG. 4 is a flow chart showing the key stages in the manufacture of a prior art laminated disposable cup.

Prior art disposable paper cups and other similar containers such as those for holding ice cream, yoghurt and fast food items are typically all formed by a similar process, illustrated by the flow chart in FIG. 4. The containers are usually formed from laminated card having a coating of polyethylene or another suitable plastics material, on one or both sides of the paperboard.

In the manufacturing process a flat is first stamped 10 from a sheet of pre-laminated paperboard, or cardboard. This flat is used to form the walls of the container. The flat is rolled 12 around a conical male former so that the edges of the flat overlap. A heat gun presses the two edges together and the heat melts the plastics layer so that the edges are welded together 14. This forms the continuous wall of the container.

In a separate action, circular, or disc-shaped, bases for the containers are stamped 16 from another sheet of pre-laminated card. Each of the bases is then pressed 17 to form a flange around the circumference of the base. A base is inserted 18 into the end of the conical wall of the container. The base is heat welded around its flange to join it to the container wall, in a similar way to the seam along the edges of the wall.

A hot tool is then used to roll or curl 20 the top edge of the wall of the container to form a rim. This process may involve the use of a succession of tools allowing a tightly rolled edge to be formed. If a lid is used with the container, then the lid will usually include retaining features that engage with the rim of the container to hold the lid on the container.

The problem with these laminated cups or containers is that the plastics coating cannot easily be separated from the cardboard outer layer so that recycling of these containers is difficult. It is preferable, therefore, to provide a container in which the cardboard outer layer and plastic lining are more easily separable. However, there are a number of important design constraints on the finished container that must be considered, in particular when the container is a disposable cup.

These design constraints include the fact that the disposable containers must be quick to produce and cost effective. The manufacturing process must also be very reliable so that the containers that are produced are consistent, with a very low failure rate. Current disposable cups can be produced at a rate of up to 200 cups per minutes and have a failure rate of only about one per million. It is desirable to achieve the same, or ideally a lower, failure rate with any new design of container.

To allow the containers to be transported and stored easily and to reduce storage and transportation costs the containers should ideally be stackable. Preferably the containers should nest so that the majority of the volume of a second container can be contained within the volume of a first container in a stack.

The outer layer and the lining of the container should be able to be manually separated quickly and easily. It should not be necessary to apply a large force to the lining to peel it away from the outer layer or shell. The lining of a container will, typically, still be contaminated with food and drink residues and, as such, if a large force were required to separate the lining it is likely that this force would cause these residues to be spilt.

Figure 5:
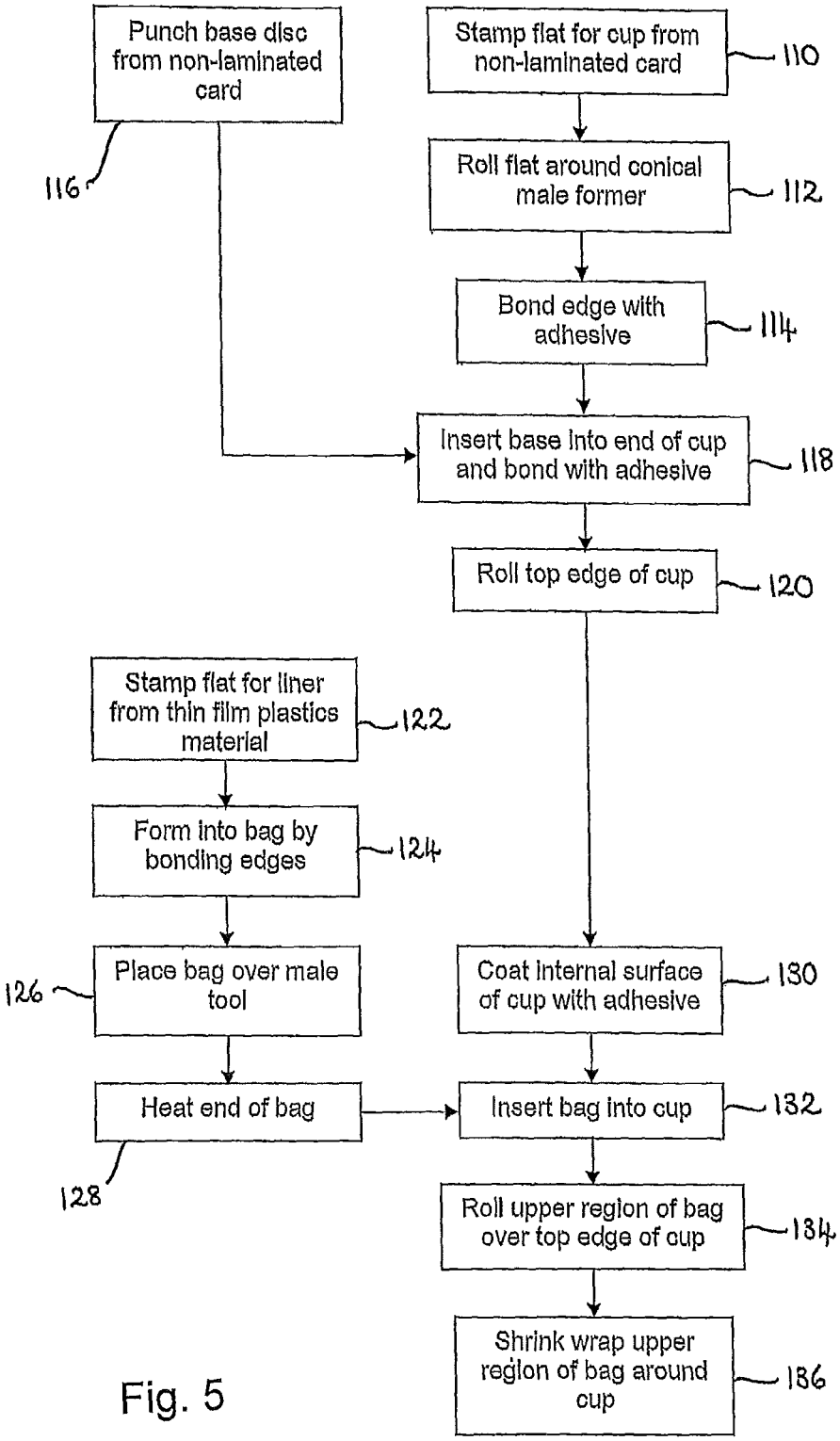
FIG. 5 is a flow chart showing the stages in the manufacture of a disposable cup according to a first preferred embodiment of the present invention.

A method of forming a disposable cup 30 according to the present invention is illustrated in the flow chart of FIG. 5. FIGS. 6 to 13 show views of the cup 30, or its components, at different stages during the manufacturing process. The following description refers, in particular, to the manufacture of disposable cups, but it will be appreciated that the method may be used to form similarly shaped containers used, for example, as yoghurt pots, ice-cream tubs, fast food containers, as well as containers for non-food items.

The container 30 of the present invention comprises an outer layer, or shell 32 and an inner layer, or lining 34. The outer layer 32 is made from a paperboard material and the inner layer 34 is made from a thin-film plastics material. In this way, the inner plastics lining 34 forms a non-permeable barrier layer to hold any liquids within the container 30.

In this example, the outer shell 32 is formed by a paper cup 36 made in the traditional way, as described above, except that the paper cup 36 is made using non-laminated or uncoated paperboard. The steps in the process of forming the paper cup 36 are shown in FIG. 5.

A flat is first stamped 110 from a sheet of paperboard or cardboard, which is made from 100% paper and is not laminated or coated with a plastics layer. This flat is used to form a wall 38 of the paper cup 36. The flat is rolled 112 around a conical male former so that the edges of the flat overlap. Adhesive is used to bond 114 the two edges together to form the continuous wall 38 of the paper cup 36. The adhesive may be of any suitable type and may be, for example, a contact adhesive applied to both edges of the flat, a 'wet' glue applied to only one of the two edges, or a heat activated glue applied to one of the two edges.

In a separate action, circular, or disc-shaped, bases 40 for the paper cup 36 are stamped 116 from another sheet of non-laminated card. Each of the bases 40 may then pressed to form a flange (not shown) around the circumference of the base 40. A base 40 is inserted 118 into the end of the conical wall 38 of the paper cup 36 and adhesive is used to bond the base 40 to the cup wall 38. The base 40 may be bonded to the wall 38 around the flange.

A hot tool is then used to roll or curl 120 a top edge of the wall 38 of the paper cup 36 to form a rim 42, around the opening 43 of the cup 36.

Figure 6:
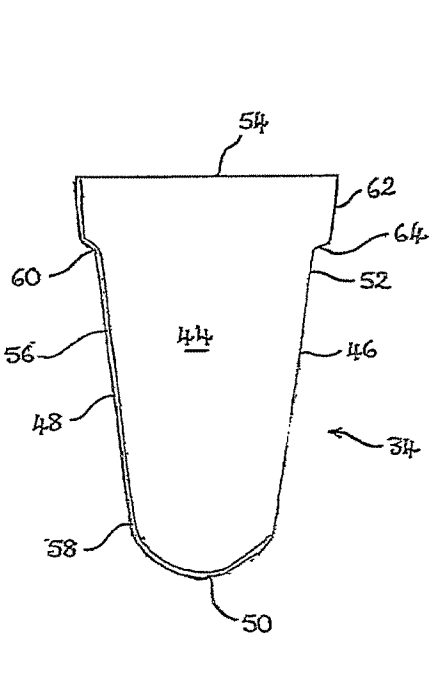
FIG. 6 is a plan view of a bag formed from a thin plastics film used to form a lining in a disposable cup according to a preferred embodiment of the present invention.

To form the inner lining 34 a thin sheet of plastics material 44 is first cut 122 to create a flat for forming the lining 34. In this example, and as shown in FIG. 6, the plastics film 44 is folded along a first edge 46 and then bonded 124 along a second edge 48 and a base region 50 so as to form a bag 52 having an opening along a top edge 54. In other embodiments it may be preferable to form the bag 52 from two separate plastic sheets which are bonded together along both the first and second edges 46, 48 and the base region 50.

Preferably the sheet(s) of plastics material 44 are bonded together by being heat welded using a technique that is well known in the art. The welding process may also trim any excess plastics material from around the edges in one step, as is known in the art. Alternatively the plastics sheets may be bonded together using a suitable adhesive or using any other suitable means.

In this example the lining 34 is made from thin-film polyethylene; however, the lining 34 may be made from any suitable thin-film plastics material. In the case of yoghurt pots, or other containers for foodstuffs, the lining 34 may be made from a laminate including ethylene vinyl alcohol (EVOH) which is known to have good oxygen barrier properties. Additionally, the material of the lining 34 must be able to withstand the temperatures that the container 30 may be exposed to, and so, for example in the case of a disposable cup, the lining 34 must not distort or change behaviour when in contact with liquid up to 100° C. Preferably the thickness of the lining 34 is less than 50 μm, and more preferably, when used for disposable cups for example, less than 30 μm. The thinner the lining 34 the lower the cost of materials and the less waste that is formed. However, the lining 34 should be thick enough that it does not tear during the manufacturing process or during use of the container 30. Additionally, containers such as yoghurt pots require the use of a thicker lining, up to about 50 μm, so that the lining 34 also acts as an oxygen barrier to improve the shelf-life of the product within the container 30.

The shape of the resulting lining bag 52 is designed to substantially conform to the internal shape of the outer shell 32. As such, in this example, the first and second edges 46, 48 are not parallel so that the bag 52 has a conical or tapered section 56. The length of this tapered section 56 is equal to the height of the paper cup outer container 36, between the base 40 and the rim 42. Furthermore, the diameter of the bag 52 at a first, narrower end 58 of the tapered section 56 is substantially equal to the diameter of the outer container 36 at its base 40, and the diameter of the bag 52 at a second, wider end 60 of the tapered section 56 is substantially equal to the diameter of the outer container 36 at its rim 42.

The bag 52 also includes an upper, flared section 62 between the tapered section 56 and the top edge 54. The diameter of the bag 52 in this flared section 62 is greater than the diameter of the bag 52 at the second end 60 of the tapered section 56 so that there is a step 64 in the shape of the bag 52 at this point. The purpose of this flared section 62 will be described further below.

Figure 7:
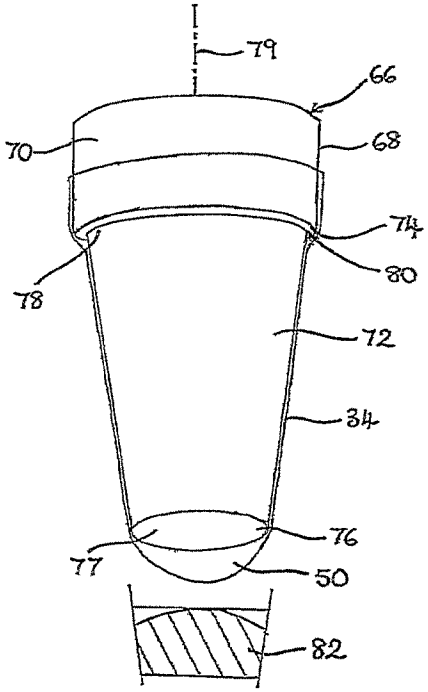
FIG. 7 is a view of the bag of FIG. 6 placed over the end of a male tool, and heating means used to heat shrink a base portion of the bag.

Once the bag 52 has been formed, it is then fitted 126 over the end of a male former 66, as shown in FIG. 7. The male former 66 comprises a shaft 68 having a circular cross-sectional shape. The shaft 68 may be made from any suitable material such as metal or a plastics or resin material. The shaft 68 includes a stem portion 70 and a tapered section 72, extending from an end 74 of the stem portion 70 to a distal end 76 of the shaft 68. The distal end 76 of the shaft 68 has a flat surface 77 that is perpendicular to a longitudinal axis 79 of the shaft 68. The dimensions of the tapered section 72 are almost identical to the internal dimensions of the outer container 36. As such, the length of this tapered section 72 is equal to the height of the cup 36, between the base 40 and the rim 42, the diameter of the tapered section 72 at the distal end 76 is substantially equal to the diameter of the cup 36 at its base 40, and the diameter of the tapered section 72 at a second end 78 is substantially equal to the diameter of the cup 36 at its rim 42, so that there is a close fit of the male former 66 within the outer container 36 as will be discussed below.

Furthermore, the diameter of the end 74 of the stem portion 70 is greater than the diameter of the second end 78 of the tapered section, so that there is a step 80 in the shape of the male former 66 at this point.

When the bag 52 is fitted over the end of the male former 66, the dimensions of the bag 52 and the tapered section 72 of the male former 66 mean that there is a close fit of the bag 52 to the shaft 68. Furthermore, the step 80 in the shaft 68 is coincident with the step 64 in the bag 52 so that the flared section 62 of the bag 52 extends over the stem 70 of the male former 66.

Because the bag 52 is made from flat sheets of a plastics material, the bag essentially has a 2-dimensional shape. When the bag 52 is placed over the male former 66, the end region 50 of the bag 52 does not, at this stage, conform to the shape of the distal end 76 of the male former 66. In particular, pleats of excess material are formed at the end region 50 of the bag 52. The next step in the process is, therefore, to shape the end region 50 of the bag 52 to conform as closely as possible to the flat surface 77 of the distal end 76 of the shaft 68.

In this example, a heat source 82 is used to heat 128 the end region 50 of the bag 52 while it is in position over the end of the male former 66. The end region 50 of the bag 52 is heated to a temperature above the heat shrink temperature, but below the slip point temperature at which the material softens significantly. Heating the end region 50 in this way causes this part of the bag 52 to shrink and conform to the shape of the distal end 76 of the male former 66. Preferably the bag 52 is formed in such a way that the polymer chains in the plastics material used to form the bag 52 are aligned substantially in a direction across the bag 52, so that the bag 52 has the maximum shrinkage memory across the width of the bag 52.

The lining 34 is then secured within the outer shell 32. In this embodiment the bag 52 is secured to the cup 36 using a suitable adhesive. The adhesive should have a low peel strength but a moderate shear strength, similar to the adhesive used on Post-It® Notes. The moderate shear strength of the adhesive means that the thin-film lining 34 will remain stuck to the internal surface of the outer shell 32 during use of the container 30. Also, as the containers 30 will typically be nested during transportation or storage, it is important that, when the containers 30 are separated from each other, the lining 34 does not get pulled away from the outer shell. However, the low peel strength means that minimal force is then required to peel the lining 34 away from the outer shell 32 after use, in order to dispose of and recycle the lining 34 and the outer shell 32 separately. The peel strength should be low enough that it is relatively easy for both younger children and the elderly to separate the lining 34 and the shell 32 of a container 30. Preferably the peel strength of the adhesive use to bond the lining to the shell is less than 0.05 N, and more preferably between 0.02 N and 0.04 N.

The adhesive is preferably applied 130 to the internal surface (not shown) of the cup 36, however, in other embodiments, the adhesive may be applied to either the external surface 84 of the tapered section 72 and base region 50 of the bag 52 or to both surfaces of the bag and cup.

Preferably the adhesive is applied to the internal surface of the cup 36 as the application of the adhesive to these surfaces may be easier to control and, in particular, there may be less over-spray created.

However, with the use of some adhesives in some embodiments of the invention it may be desirable to apply the adhesive to the external surface 84 of the bag 52. This may be necessary so that, when the bag 52 is peeled away from the cup 36, the adhesive remains on the bag 52 and not on the internal surface of the cup 36. This is a similar concept to the adhesive applied to a rear surface of a Post-It® Note so that when the Post-It® Note is separated from a surface, including another Post-It® Note, the adhesive remains on the rear of the Post-It® Note and not on the surface.

The adhesive is preferably spray applied to ensure an even coverage or coating of the adhesive over the surface of the bag 52 and/or container 36.

In some embodiments it may be preferable if the lining 34 is more strongly adhered to the outer shell 32 in an upper region of the internal surface than in a lower region. In particular, the lining 34 may be most strongly adhered to the shell 32 around the rim 42 and the lining 34 may be most weakly adhered to the shell 32 at its base 40.

In some embodiments, a first, higher level of adhesion may be used between upper regions of the internal surface of the shell 32 and the lining 34 and a second, lower level of adhesion may be used between lower regions of the internal surface of the shell 32 and the lining 34. In other embodiments, a highest level of adhesion may exist between the lining 34 and the shell 32 around the lip 42 and a lowest level of adhesion may exist between the base 40 of the shell 32 and the lining 34, with the level of adhesion varying smoothly between these two regions.

Figure 8:
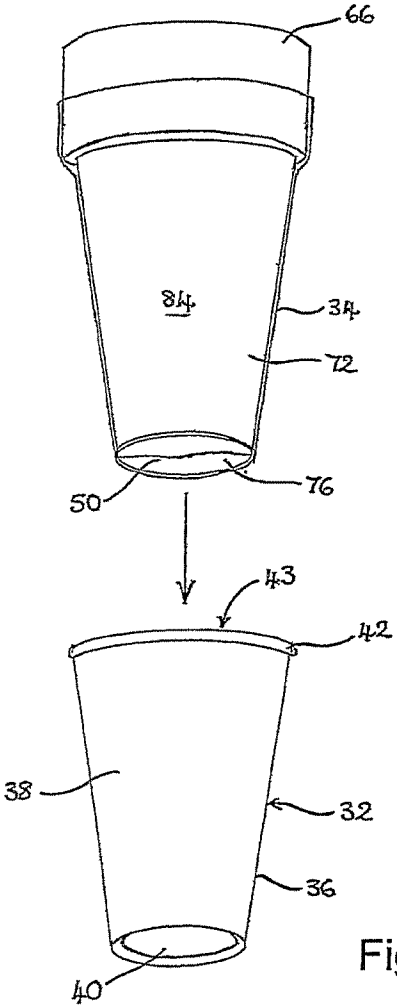
FIG. 8 is a view of the bag and male tool of FIG. 7 with the base section of the bag conforming to the end of the tool, and a paper cup into which the bag is inserted.

As indicated in FIG. 8, the male former 66 is then fully inserted 132 into the cup 36 so that the end region 50 of the bag 52, over the distal end 76 of the shaft 68, presses down onto the base 40 of the cup 36. Due to the dimensions of the tapered sections 56, 72 of the bag 52 and shaft 68, with the male former 66 fully inserted into the cup 36, the external surface 84 of the tapered section 56 of the bag 52 is pressed firmly against the internal surface of the wall 38 of the cup 36.

It is important that the dimensions of the bag 52 match as accurately as possible the internal dimensions of the cup 36, and that the male former 66 fits tightly into the cup 36, so that the bag 52 is adhered to the internal surfaces of the cup 36 as smoothly as possible. In particular, it is desirable if there are no creases or wrinkles in the base 50 of the bag 52 covering the base 40 of the cup 36. This is to prevent, for example, sugar getting trapped within folds of the thin-film lining 34 or a spoon catching on a crease and tearing the lining 34.

Alternatively, the diameter of the male former 66 may be made slightly smaller than the diameter of the container 36. In these embodiments, the bag 52, which still has the same dimensions as the inside of the container 36, is first drawn around the male former 66 for example by the use of suction towards the male former 66. The male former 66 is then inserted into the cup 36 as described above. Once fully inserted into the cup 36, air may then be used to blow the bag 52 outwards away from the male former 66 and onto the internal surfaces of the cup 36. Alternatively, air may be drawn through the cup 36 to suck the bag 52 outwards onto the internal surfaces of the cup 36. This method prevents the lining adhering or tearing as the male former 66 is inserted into the cup 36.

In some embodiments a heat sensitive adhesive may be used. The heat sensitive adhesive may be applied to the external surface 84 of the bag 52, or may be applied to a surface of the plastics film used to form the bag 52 prior to forming the bag 52. The heat sensitive adhesive is preferably only tacky when heated above a certain temperature. In this way, the bag 52 may be inserted into the cup 36 in a state in which the adhesive is not tacky. Heat is then applied to either the male former 66 or around the outside of the cup 36 to increase the temperature and cause the adhesive to become tacky and adhere to the inside of the cup 36.

Additionally, in some embodiments it may be desirable to apply a partial vacuum between the lining 34 and the outer shell 32 to improve the adhesion of the lining 34 to the internal surfaces. In some of these embodiments it may be possible to draw air through a relatively porous paperboard shell 32. In other embodiments, one or more small holes are provided in the outer shell 32, for example around the periphery of the base, through which air may be drawn. As the lining 34 is inserted into the shell 32, air is drawn through the shell 32 or the holes creating a partial vacuum between the lining 34 and the shell 32, thereby drawing the lining 34 against the internal surface of the shell 32, particularly adjacent the holes when present. The vacuum assists in the removal of air pockets between the lining 34 and the shell 32, and in those embodiments including holes, it may be desirable to form a regular pattern of fine holes over the whole area of the base 40 and wall 38 of the shell 32 so that the lining 34 is drawn evenly toward the shell 32 creating a smooth lining 34 over the whole area.

Once the bag 52 has substantially adhered to the cup 36, the male former 66 is withdrawn.

Air pockets between the lining 34 and the shell 32 may also be removed, or minimised, in some embodiments by the use of brush means (not shown). One or more brush heads may be lowered into the container 30. A plurality of bristles attached to the brush heads may then be swept across the internal surface of the lining 34 to smooth the lining 34 and remove any remaining air pockets.

Figure 10:
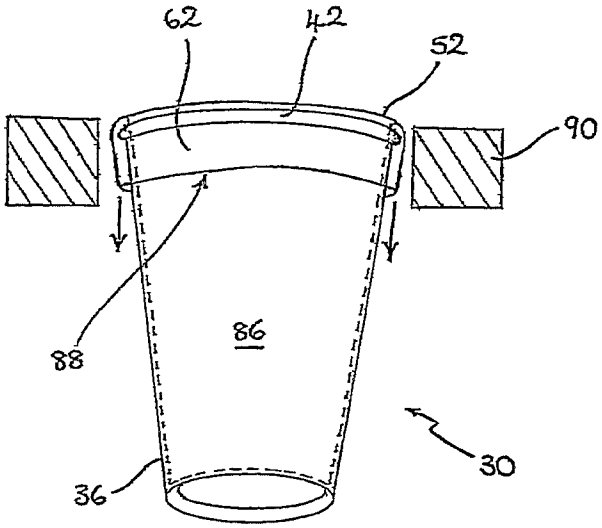
FIG. 10 shows the bag and paper cup of FIG. 9 with the upper region of the bag wrapped over the top edge of the paper cup, and heating means used to shrink wrap the upper region around the outside of the paper cup.
Figure 9:
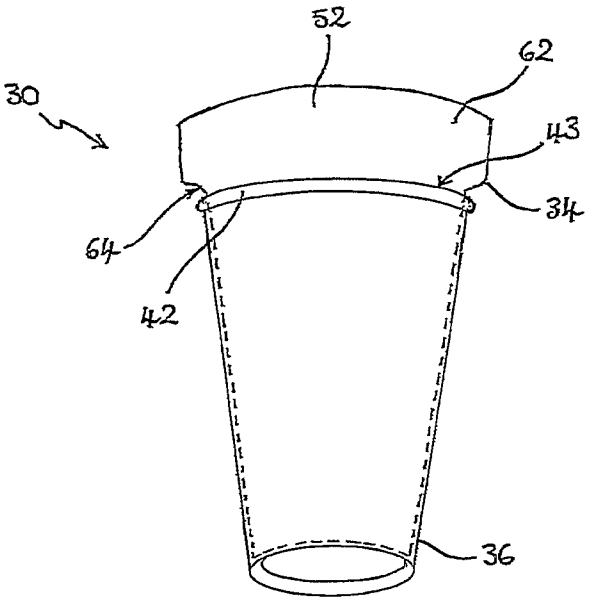
FIG. 9 shows the bag and cup of FIG. 8, with the bag inserted into the paper cup and the tool removed, and an upper region of the bag proximate the open end protruding beyond the top of the paper cup.

With the lining 34 fully inserted and adhered to the internal surface of the shell 32, as described above, the step 64 in the bag 52 is now located just above the rim 42 of the cup 36 and the flared section 62 of the bag 52 protrudes from the top opening 43 of the cup 36, as shown in FIG. 9. The diameter of this flared section 62 is greater than the diameter of the rim 42 of the cup 36 so that this upper region 62 of the bag 52 can be folded down over the rim 42. As shown in FIG. 10, the flared section 62 of the bag 52 is rolled or folded 134 over the rim 42 of the cup 36, as indicated by the arrows, so that this flared section 62 surrounds an exterior surface 86 of an upper region 88 of the cup 36 proximate the rim 42.

Heating means 90 is then used to shrink 136 the flared section 62 of the bag 52 around the outside of the cup 36. The heating means 90 is ring-shaped and has an internal diameter larger than the external diameter of the rim 42 of the container 36, such that the heating means 90 can completely surround the upper region 88 of the cup 36. Once the flared section 62 of the bag 52 has been folded over the rim 42, the heating ring 90 is lowered over or raised up around the container 36 so that it is aligned with the upper region 88 of the container 36.

The flared section 62 of the bag 52 is heated to a temperature above the heat shrink temperature, but below the slip point temperature. In this way, the flared section 62 of the bag 52 shrinks and conforms to the shape of the external surface 86 of the upper region 88 of the cup 36.

In embodiments in which the outer shell 32 is a cup 36 and/or includes a rim 42 to which a lid 92 is secured, it is particularly important that the lining 34 conforms as closely as possible to the rim 42 of the outer shell 32.

If a user of the container 30 is going to drink from the container 30 by placing his or her lips over the rim 42, it is preferable if their lips do not come into direct contact with the paperboard shell 32, but instead rest or seal against the plastics lining 34. This not only prevents the upper region 88 of the shell from absorbing moisture, but also ensures that the rim 42 feels nice against the user's lips. Wrapping the plastics lining 34 over the rim 42 of the cup 36 also prevents beverage, for example coffee, soaking into the cup 36 in this region and forming stains around the cup 36.

Figure 11:
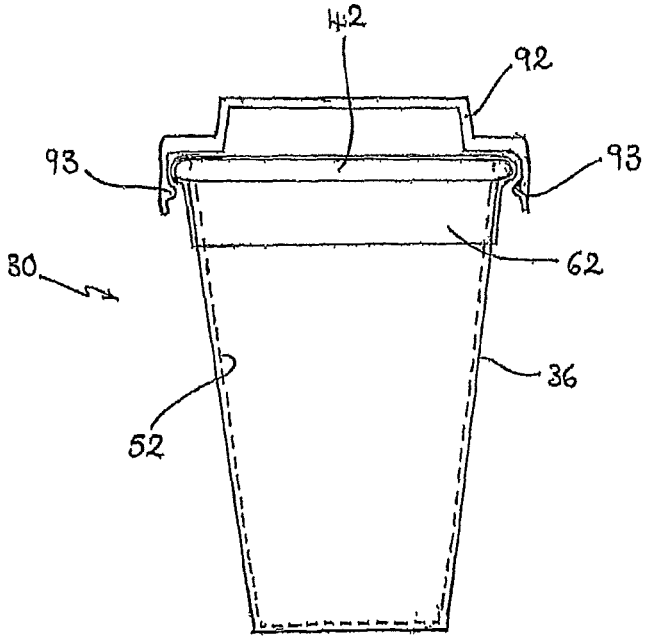
FIG. 11 shows the disposable cup of the present invention including a lid.

Furthermore, as mentioned previously, a lid 92 of the container 30 will typically include means 93 for securing the lid 92 to the rim 42 of the container. As such, it is desirable if the shape of the rim of the container 30 after the lining 34 has been inserted does not vary significantly from the standard shape of rim so that conventional lids 92 may still be attached to the top of the container 30 as shown in FIG. 11. In particular the rim must resist the loads of the lid, for example the forces applied to the lid to attach it to and remove it from the container, and the rim should provide exactly the same, if not improved, sealing as compared to a rim of a traditional laminated cup.

In some embodiments it may be preferable to additionally apply an adhesive between the flared section 62 of the bag 52 and the upper region 88 of the cup 36. This would be the same adhesive as applied on the internal surfaces of the cup 36 and would still permit the edge 54 of the bag 52 to be easily peeled away from the exterior surface 86 of the cup 36.

In order to remove the lining 34 from the shell 32 after use, it is first necessary to peel the flared section 62 of the lining 34 away from the exterior surface 86 of the cup 36 and over the rim 42. However, this section 62 of the lining 34 has been shrink wrapped around the cup 36 and, because of the tapered shape of the wall 38 of the cup 36, it is not possible to simply fold the edge 54 of the lining 34 back over the rim 42.

Figure 12:
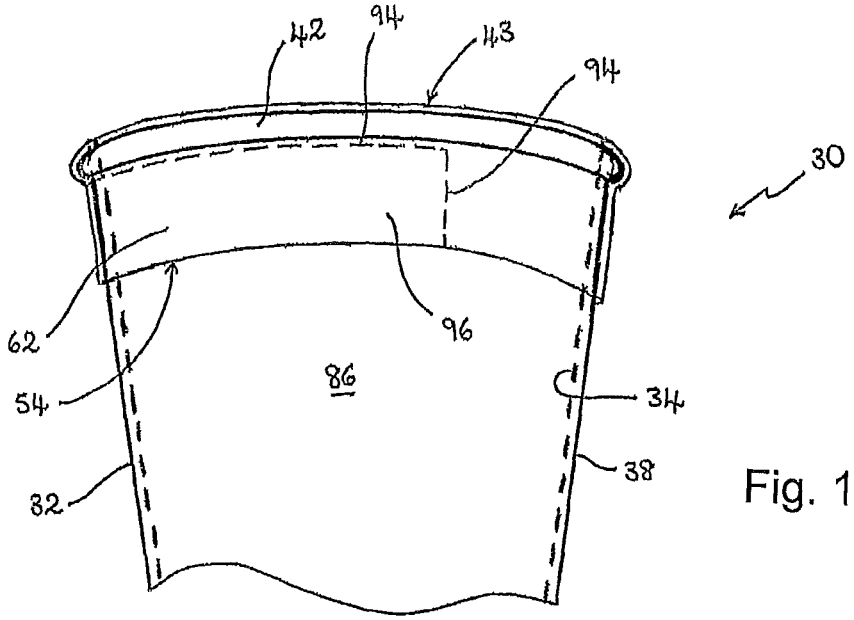
FIG. 12 shows the bag and cup of FIG. 10 with the upper region shrink wrapped around the cup and perforations formed in the plastics film.

To aid in the removal of the lining 34, the flared end region 62 of the lining 34 preferably includes perforations 94, as shown in FIG. 12. These perforations 94 allow a user of the container 30 to tear a portion of the shrink wrapped section 62 of the lining 34 away from the exterior surface 86 of the cup 36 in order to subsequently peel the lining 34 away from the interior surface of the cup 36. The perforations 94 extend around the cup 36 a small distance below the rim 42 and preferably extend between a half and three-quarters of the way around the circumference of the cup 36.

It should be noted that the location of the perforations 94 relative to the rim 42 should not be such that they compromise the sealing of any lid 92 that may be placed over the container 30. In particular, the perforations 94 should not be located at the point of contact of the means 93 for securing a lid 92 to the container 30 as described above, and should ideally be located below the sealing line of the lid 92 around the cup 36.

To remove the lining 34 from the shell 32, a user first tears a vertically oriented line of perforations 94 to form the end of a tab 96. The user then continues to pull the tab 96 and tears along the line of perforations 94 extending circumferentially around the container 30. When the end of the perforations 94 is reached, a continued pulling force exerted on the detached portion of lining 34 then causes the remainder of the lining 34 to peel away from the exterior 86 and interior surfaces of the cup 36.

Once the lining 34 has been removed, it may be disposed of and the remaining cup 36 or outer shell 32, which is 100% paper or cardboard, can be recycled using conventional methods.

Figure 13:
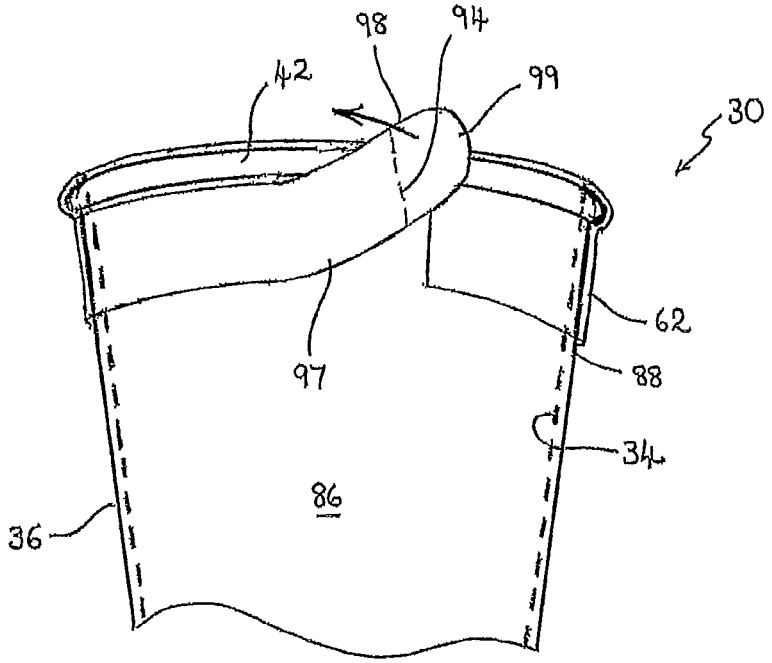
FIG. 13 shows the bag and cup of FIG. 12 with a pull strip and tab attached to the upper shrink wrapped portion of the plastics film.

To make the lining 34 easier to remove, it may be desirable, in some embodiments, to include an outer 'tear-off' strip 97 that covers and is attached to all or part of the shrink wrapped portion 62 of the lining 34 that covers the external surface 86 of the upper region 88 of the cup 36. The outer strip 97 is attached to the end region of the lining 62 so that the vertical line of perforations 94 is located in, and attached to, an end portion 98 of the strip 97. A free end or tab 99 of the outer strip 97 extends beyond the line of perforations 94 and is not secured to either the lining 34 or cup 36, as shown in FIG. 13.

To remove the lining 34 from the cup 36, a user grips and pulls the tab 99 of the outer strip 97 away from the exterior surface 86 of the cup 36 which causes the lining 34 to tear along the vertically oriented line of perforations 94. Continued pulling of the tab 99, as indicated by the arrow in FIG. 10, causes the lining 34 to tear along the line of perforations (not shown) extending circumferentially around the container 30. When the end of the perforations 94 is reached, between about halfway and three-quarters of the way around the container 30, the pulling force on the strip 97 then causes the remainder of the lining 34 to peel away from the exterior 86 and interior surfaces of the cup 36.

Preferably the outer strip 97 is made from a paperboard material, the same as or similar to the material used to form the shell 32 of the container 30. In this way, the outer strip 97 provides an additional area on the exterior surface 86 of the container 30 onto which information or branding may easily be printed.

Although the foregoing description has focussed on the manufacture and form of disposable cups, the present invention is also applicable to other similar containers such as yoghurt pots.

Figure 14:
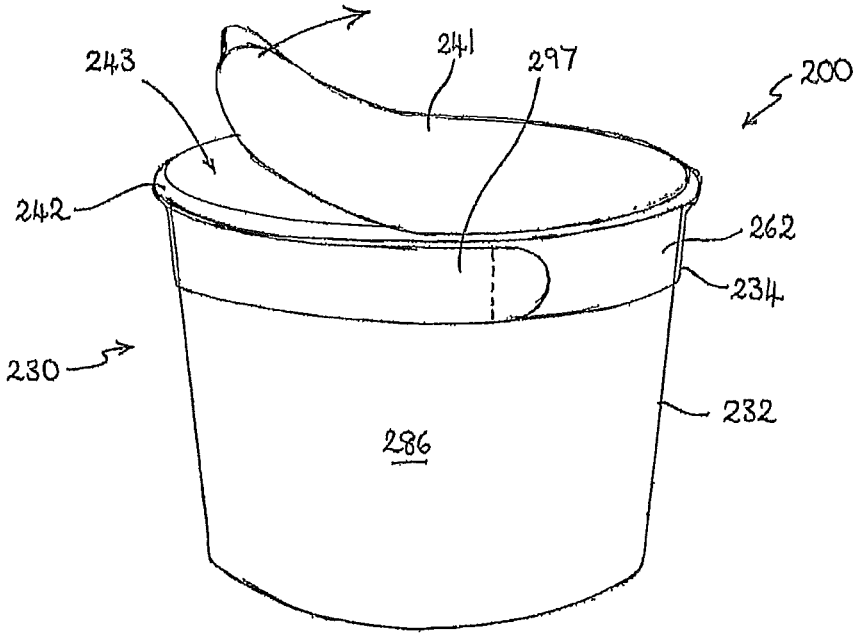
FIG. 14 shows a yoghurt pot according to a second preferred embodiment of the present invention, the pot having a removable lid and a separable outer shell and inner lining.

FIG. 14 shows an embodiment of a yoghurt pot 230 having substantially the same construction as the container 30 described above. As such, like features of the embodiment will be referenced by numerals incremented by 200.

The yoghurt pot 230 comprises an outer shell 232 formed from a paperboard material and a lining 234 formed from a thin film plastics material. The lining 234 is adhered to the shell 232 as described above and includes an outer end region 262 of the lining 234 that surrounds an exterior surface 286 of the shell 232 proximate a rim 242 of the container 230. The container 230 also includes a tear-off strip 297 attached to the end region 262 of the lining 234. The function of this tear-off strip 297 is the same as that described above and, as such, will not be discussed further.

As is also the case with many traditional yogurt pots, the yogurt pot 230 of the present invention includes a sealing layer or lid 241 formed from a sheet of plastics material or metal foil. The sealing layer 241 is adhered to the rest of the container 230 around the rim 242 so that the sealing layer 241 completely covers and seals the top opening 243 of the container 230. The sealing layer 241 will typically be adhered fairly strongly to the rim 242 to prevent the sealing layer 241 peeling off accidentally during transportation or storage. However, in use, a consumer will tear or peel off the sealing layer 241 of the yogurt pot 230 to gain access to the contents of the container 230, as indicated by the arrow in FIG. 14.

Because the sealing layer 241 needs to be firmly attached to the rim 242 of the container 230 and must be peelable as described above, it is necessary to securely attach the lining 234 to the shell 232 around the rim 242 so that the lining is not torn or peeled away from the shell 232 during removal of the sealing layer 241. It is, therefore, desirable to adhere the lining 234 to the rim 242 and exterior surface 86 of the shell 232 using a suitable adhesive, such as that used to adhere the lining 234 to the interior surface of the shell 232.

Figure 15:
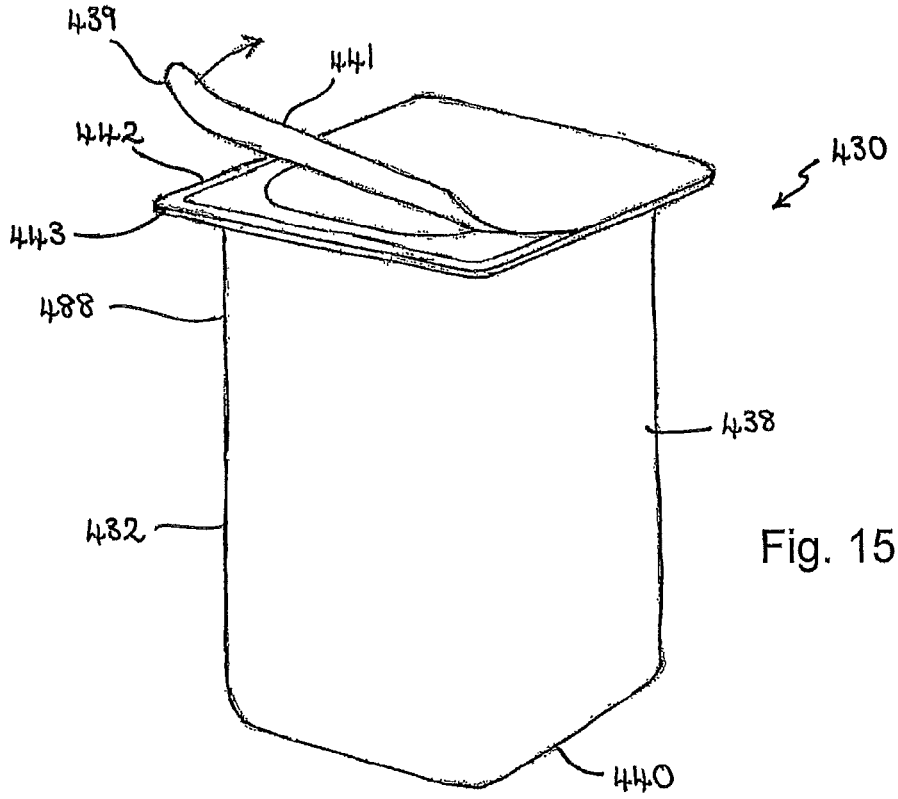
FIG. 15 is a perspective view of a container for a foodstuff, comprising a shell and lining and including a sealing layer shown partially removed, according to a third preferred embodiment of the present invention.
Figure 16:
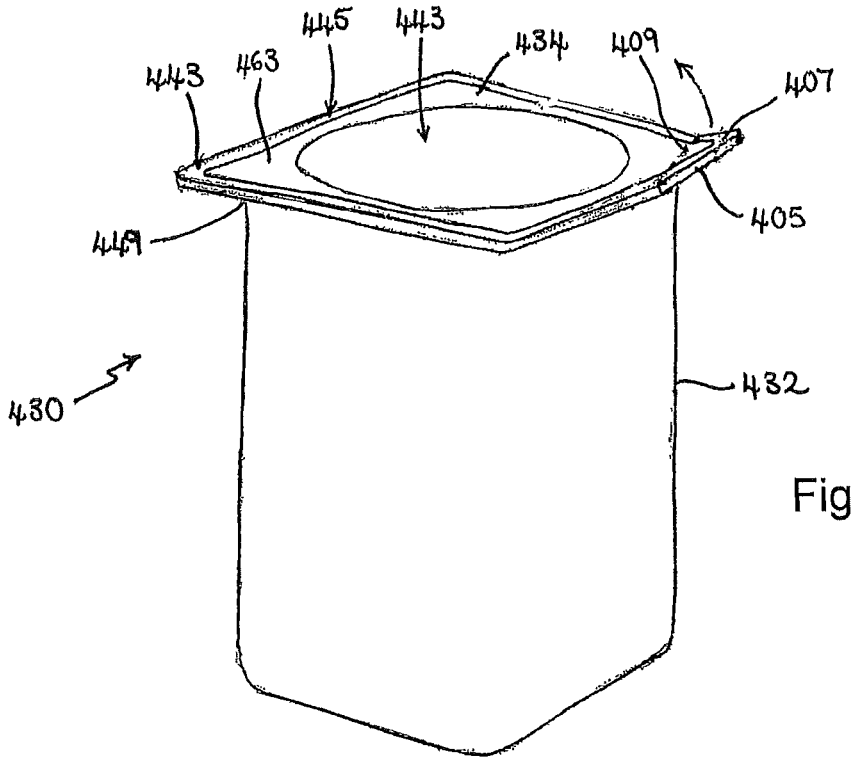
FIG. 16 is a perspective view of the container of FIG. 15, with the sealing layer fully removed and showing a tab partially separated for removing the lining from the shell.

FIGS. 15 and 16 show a further embodiment of a container 430 of the present invention. In this example, the base 440 has a generally square shape with rounded corners and the side wall 438 of the shell 432 forms a substantially square-shaped tube extending from the base 440 and surrounding an internal volume of the container 430. In contrast to the embodiments described above, the side wall 438 of the container 430 extends perpendicularly from the base 440 such that a cross-sectional area of the container 430 is substantially the same in an upper region 488 of the container 430 and near the base 440 of the container. At the top edge 449 of the container 430 a rim 442 including a flange 443 extends outwards around the perimeter of the top edge 449. Containers 430 such as those illustrated in FIGS. 15 and 16 are typically used for foodstuffs such as yoghurts or desserts.

A lining 434 extends within the shell 432 and is adhered to the internal surface (not shown) of the shell 432. Preferably the lining 434 extends beyond the top edge 449 of the container 430 and an end region 463 of the lining 434 is adhered to an upper surface 445 of the rim 442 of the shell 432. Preferably, the lining 434 is most strongly adhered to the shell 432 in the end region 463 around the rim 442 and the remainder of the lining 434 covering the internal surfaces of the side wall 438 and the base 440 of the shell 432 is more weakly adhered to the shell 432 in these areas, to enable the lining 434 to be easily peeled away from the shell 432.

The container 430 further comprises a sealing layer or lid 441 in the form of a thin sheet or film that extends fully across the top of the container 430 thereby covering the upper surface 445 of the rim 442 and the opening 443. In this example, the sealing layer 441 is a foil sheet that is weakly adhered to the rim 442 of the container 430 around the periphery of the opening 443. As such at least one corner region 439 of the sealing layer 441 is not attached to the rim 442 and forms a grip which a user of the container 430 may hold to remove the sealing layer 441 from the container 430.

In use, the weak adhesion of the sealing layer 441 to the rim 442 means that a user can grip a corner 439 of the sealing layer 441 and peel the sealing layer 441 away from the rest of the container 430 with the sealing layer 441 remaining intact, as illustrated in FIG. 15.

The user can then consume the contents of the container 430. In applications in which the container 430 is filled with yoghurt or a dessert, a user may eat the foodstuff directly from the container 430 using a spoon for example. In these cases it is preferable if the entirety of the lining 434 is adhered to the shell 432 such that the lining 434 does not move with respect to the shell 432 as foodstuff is removed. This is especially important if a user wishes to scrape remnants of the foodstuff from the internal surfaces of the wall 438 and base 440 of the container 430.

Once the contents have been consumed, the user can then separate the lining 434 from the shell 432 in a similar way to that described above in relation to the previous embodiments. As shown in FIG. 16, one corner 405 of the rim 443 includes a perforated tab 407. A line of perforations 409 extends across the corner 405 of the rim 443 of the shell 432 and each of the perforations 409 extends through the shell 432 but not through the lining layer 434. A user is able to grip the tab 407 and separate the tab 407 from the rest of the shell 432. With the lining 434 remaining attached to the tab 407, the user can then peel away the lining 434 from the shell 432 for disposal.

Because of the deep shape of this container 430 and the tubular side wall 438, it may be more difficult to peel the lining 434 away from the shell 432 of this container 430. This is due to the angle at which the lining 434 is being pulled relative to the internal surface of the shell 432. In particular down the side wall 438 of the container 430 the force applied to the interface between the lining 434 and the shell 432 may be a shear force rather than a peel force, and typically shear strengths of adhesives are greater than peel strengths. As such, it may be preferable if the strength of adhesion between the lining 434 and the shell 432 is lower over the side 438 of the container 430, and especially over a lower region of the side 438, than at the base 440.

Generally, in all of the embodiments described above the lining 34, 234, 434 will be formed from a transparent or translucent thin film plastics material. As such, it would be possible to print a logo or a message, for example 'Now Peel It', on the interior surface of the base of the shell 32, 232, 432 which would be visible to a user of the container once the container was empty.

However, in some situations it may be desirable to use an opaque lining 34, 234, 434. This would allow a message or code, for example as part of a competition, to be printed on the interior surface of the shell 32, 232, 432 and hidden by the lining 34, 234, 434. The message and/or code would then be revealed once the lining 34, 234, 434 had been peeled away and separated from the shell 32, 232, 432. This could be used to encourage users to separate the lining 34, 234, 434 and shell 32, 232, 432 for recycling through, for example, the chance to win a prize if a lucky number or symbol is revealed under the lining.

Figure 17:
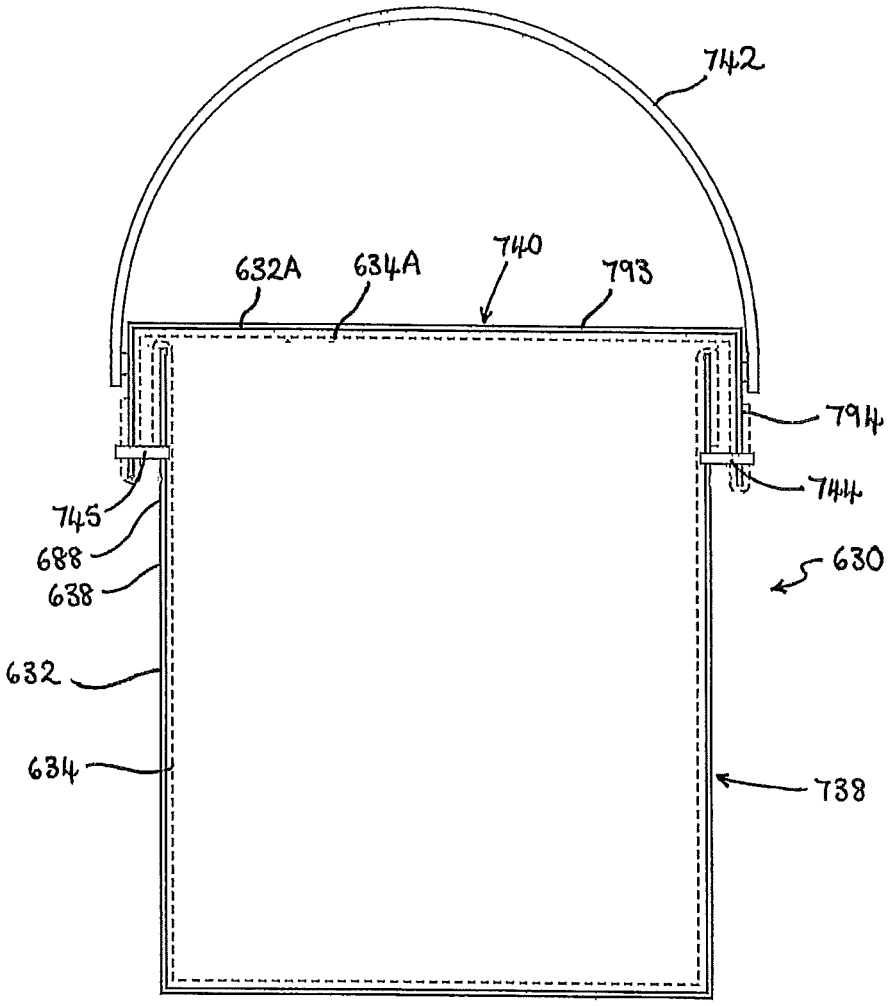
FIG. 17 is a cross-sectional view of a container with lid, having separable inner and outer layers, according to a fourth preferred embodiment of the present invention.
Figure 18:
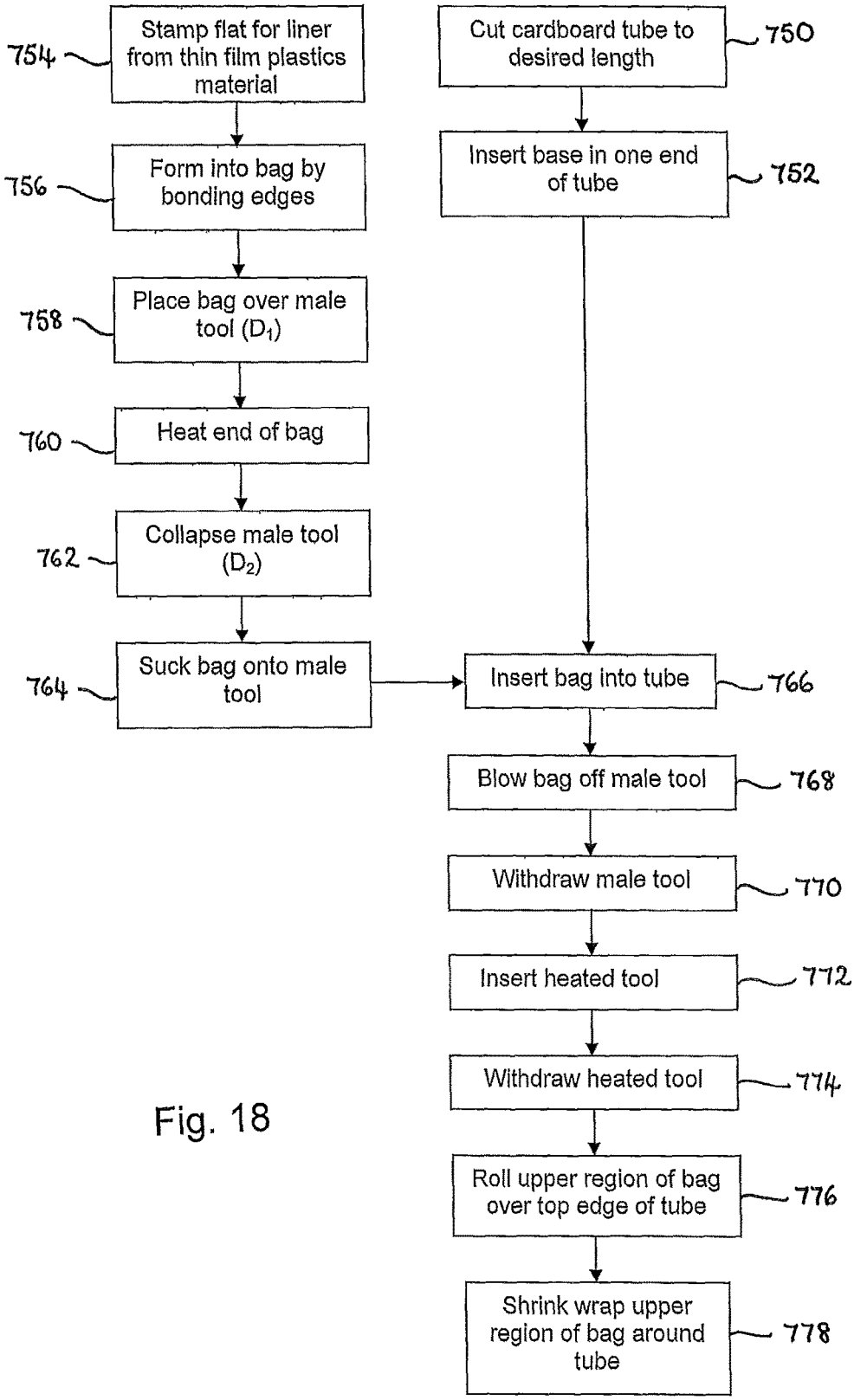
FIG. 18 is a flow chart showing the key stages in the manufacture of the container of FIG. 17.
Figure 21:
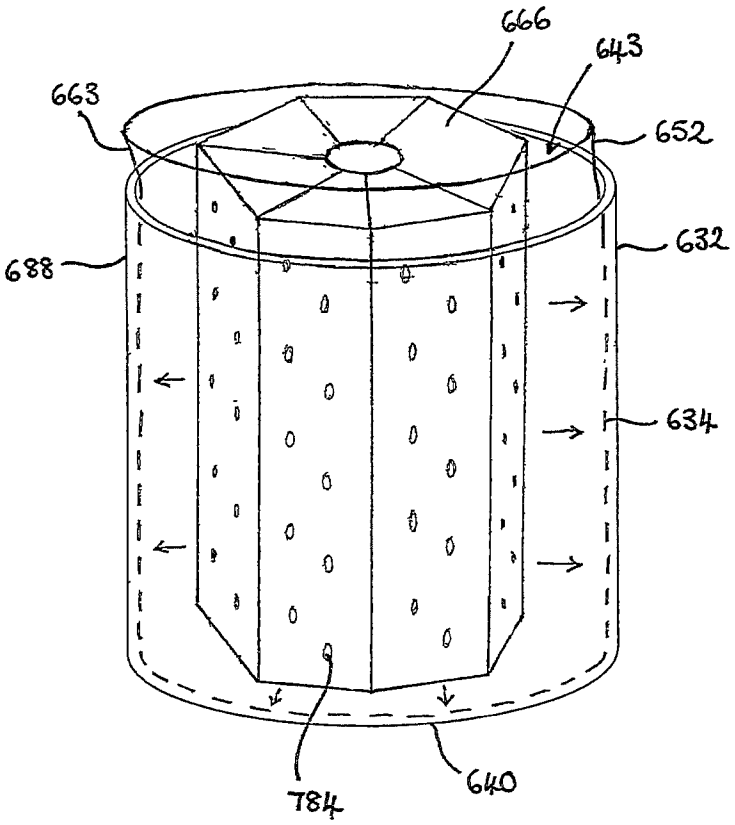
FIG. 21 is a view of the collapsed male tool inserted into the outer shell of FIG. 20 and the lining bag blown off the tool to conform to the outer shell.

FIG. 17 shows a container 630 according to a fourth preferred embodiment of the present invention. In this example the container 630 is in the form of a paint pot or other similar container that may hold hazardous liquid or semi-liquid products. The container 630 comprises a main body 738, a lid 740 and a handle 742.

Both the main body 738 and the lid 740 of the container 630 comprise two separable layers; an outer shell 632 and a peelable inner lining 634. When this container 630 is used as a paint pot, it is, therefore, only the lining 634 that is contaminated with paint residue. The lining 634 may be removed from the shell 632 to be disposed of in a suitable manner, and the non-contaminated shell 632 may be recycled in the usual way. In this way, the amount of contaminated material that must be disposed of is significantly reduced.

Suitable securing means 744 are used to secure the lid 740 tightly onto the container 730, and preferably the fit of the lid 740 over the container 630 is such that a part of the lining 634A of the lid 740 contacts a part of the lining 634 of the container 630 thereby forming a seal between the lid 740 and the container 630. The lid 740 and securing means 744 will be described in more detail later.

The method of forming the main body 738 of the container 630 will now be described with reference, in particular, to FIGS. 18 to 21.

The outer shell 632 of the main body 738 comprises a base 640 and a tubular side wall 638 extending from the edge of the base 640. The container 630 is preferably cylindrical, such that the base 640 is circular and the side wall 638 extends perpendicularly from the base 640 around its circumference. To form the shell 632, a cylindrical cardboard tube having a required diameter is cut 750 to a suitable length to form the side wall 638 of the container 630. The cardboard tube may be formed using any method, but is most typically manufactured by winding strips of paper in a continuous process, as is well known in the art.

A circular base 640, corresponding to the diameter of the tube, is then cut or punched out of a sheet of cardboard. The base 640 is inserted 752 into one end of the tube and secured to form a closed end or base of the container 630.

The outer diameter of the shell 632 is preferably consistent with equivalent plastic or metal paint pots or tins. In this way, the containers of the present invention can be manipulated and filled using existing filling lines.

To pre-form the lining 634 a sheet or film of plastics material is first stamped or cut 754 to create a flat for forming the lining 634. The film of plastics material is preferably pre-coated on one side with a heat sensitive adhesive, as described further below. Pre-coating the film with adhesive allows a more consistent result to be achieved, and additionally has the advantage that the adhesive is not applied in a separate step during construction of the container. The plastics film is then folded, with the adhesive on the outside, and bonded 756 to form a bag 652 having an opening along one edge 654. In other embodiments it may be preferable to form the bag 652 from two or more separate plastic sheets that are bonded together to form the bag 652. Preferably the sheet(s) of plastics material are bonded together by being heat welded using a technique that is well known in the art. The welding process may also trim any excess plastics material from around the edges in one step. Alternatively the edges of the plastics sheet(s) may be bonded together using a suitable adhesive or any other suitable means.

The lining 634 may be made from any suitable plastics material, but is preferably made from polyethylene. The lining material may be a laminate of a number of plastics materials including a gas barrier material such as EVOH, that will prevent paint odours being released from the container. Preferably the thickness of the lining 634 is around 100 μm. The thinner the lining 634 the lower the cost of materials and the less waste that is formed. However, the lining 634 should be thick enough that it does not tear during the manufacturing process or during use of the container 630, and in particular during removal of the lining 634 from the shell 632 as described below.

The shape of the lining bag 652 is designed to substantially conform to the internal shape of the shell 632 and, as such, when opened, the bag 652 is substantially tubular with a circular opening.

Figure 19:
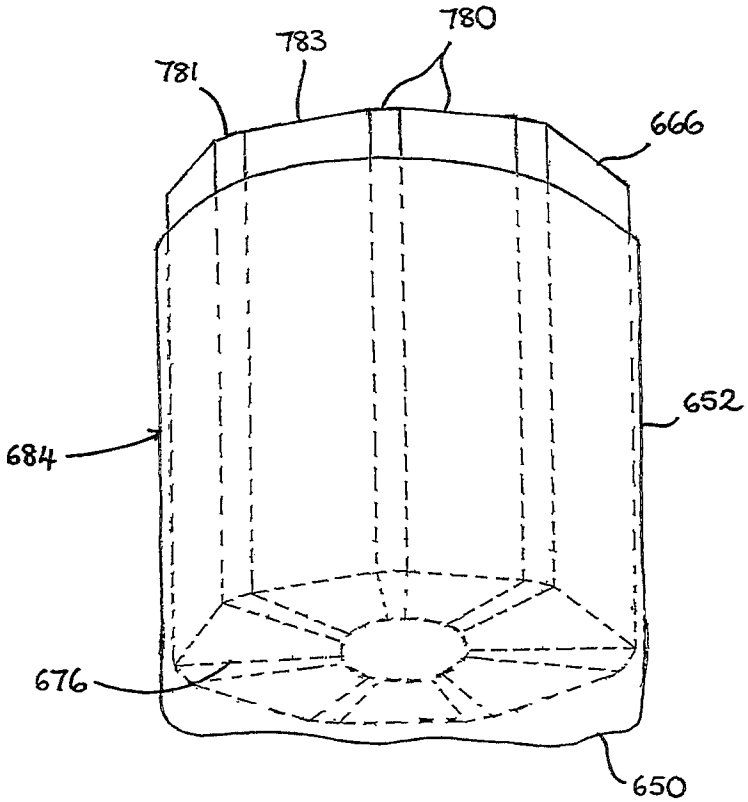
FIG. 19 is a view of a partially pre-formed lining bag place over the end of a male tool.
Figure 20:
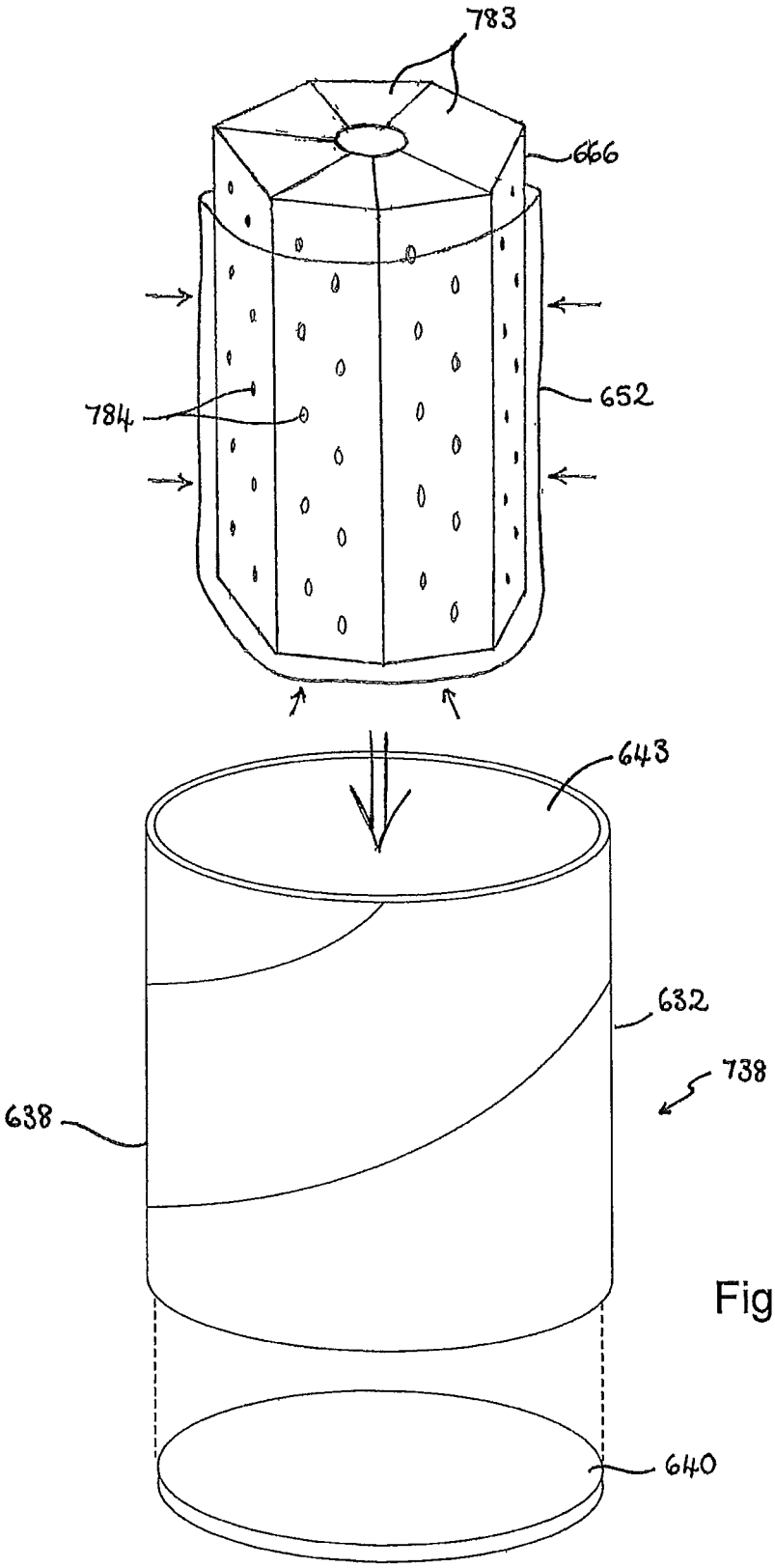
FIG. 20 is a view of a lining bag and a collapsed male tool together with a tubular outer shell into which the bag is inserted.

Once the bag 652 has been formed, it is then fitted 758 over the end of a male former or tool 666, as shown in FIG. 19. The end of the tool 666 is substantially cylindrical and has a flat end, i.e. perpendicular to the sides of the tool 666. The tool 666 is preferably a collapsible tool having a plurality of segments 780. When all of the segments 780 are in position in the tool 666, the tool 666 has a diameter (D1) substantially equal to the internal diameter of the shell 632 minus the thickness of the lining bag 652.

When the bag 652 is fitted over the end of the male tool 666, the dimensions of the bag 652 mean that there is a close fit of the bag 652 to the tool 666. However, because the bag 652 is made from flat sheets of the plastics material, the bag 652 essentially has a 2-dimensional shape. As such, when the bag 652 is placed over the male tool 666, an end region 650 of the bag 652 does not conform to the shape of the flat end 676 of the tool 666. In particular, pleats of excess material are formed at the end region 650 of the bag 652, similar to that described in relation to the disposable cup lining 34. The end region 650 of the bag 652 must, therefore, be altered to conform as closely as possible to the flat surface of the end 676 of the tool 666.

In this example, a heat source is used to heat 760 the end region 650 of the bag 652 while it is in position over the end 676 of the male tool 666. The end region 650 of the bag 652 is heated to a temperature above the heat shrink temperature, but below the slip point temperature at which the material softens significantly. Heating the end region 650 in this way causes this part of the bag 652 to shrink and conform to the shape of the flat end 676 of the male tool 666, and form a base of the bag 652.

The pre-formed lining 634 is then secured within the outer shell 632. In this embodiment the bag 652 is secured within the shell 632 using a suitable adhesive. The adhesive should have a low peel strength but a moderate shear strength, similar to the adhesive used on Post-It® Notes. The moderate shear strength of the adhesive means that the thin-film lining 634 will remain stuck to the internal surface of the outer shell 632 during use of the container 630. However, the low peel strength means that minimal force is then required to peel the lining 634 away from the outer shell 632 after use, in order to dispose of and recycle the lining 634 and the outer shell 632 separately.

In a preferred embodiment a heat sensitive adhesive is used to bond the lining 634 to the shell 632. The heat sensitive adhesive is preferably pre-applied to a surface of the plastics film used to form the bag 652 as described above, although in other embodiments the adhesive may be applied to the external surface 684 of the bag 652 once formed. The heat sensitive adhesive is preferably only tacky when heated above a certain temperature, so that the bag 652 may be inserted into the shell 632 while at a lower temperature at which the adhesive is not tacky and then, once in the correct position within the shell 632, the adhesive may be heated to a higher temperature at which the adhesive becomes tacky so that the lining 634 is bonded to the shell 632.

In other embodiments other types of suitable adhesive may be used that will still permit the lining 634 to be removed from the shell 632, as described in more detail later.

To ease the insertion of the male tool 666 and bag 652 into the shell 632, the diameter of the male tool 666 is preferably reduced by removing a first set of segments 781 from the tool 666. By removing this first set of segments 781, the remaining segments 783 collapse 762 in towards each other thereby reducing the diameter of the tool 666. To retain the bag 652 on the end 676 of the tool 666, suction 764 is used to draw the bag 652 around the tool 666. The tool 666 preferably includes a plurality of holes 784 through the segments 783 to enable air to be drawn through the tool 666 from around an external surface of the tool 666 to create a suction force as described.

The tool 666 and bag 652 are then inserted 766 into the shell 632 until the flat end 676 of the tool 666 is a short distance from the base 640 of the shell 632. Once fully inserted into the shell 632, air may then be used to blow 768 the bag 652 outwards away from the tool 666 towards the internal surfaces of the shell 632. In this way, the tool 666 preferably includes means for drawing air in a first direction through the holes 784 to create a suction force and means for blowing air in a second opposite direction through the holes 784 to blow the bag 652 away from the tool 666. In some embodiments the suction means and the blowing means may be the same device with two modes of operation. Alternatively or additionally, air may be drawn through the shell 632 to suck the bag 652 outwards onto the internal surfaces of the shell 632. The decreased diameter of the tool 666 prevents the lining 634 adhering or tearing through contact with the side wall 638 of the shell 632 as the tool 666 is inserted.

The male tool 666 is then withdrawn 770 and a second, heated tool (not shown) is inserted 772. The heated tool heats the adhesive to a temperature at which it becomes tacky so that the lining 634 adheres to the internal surfaces of the shell 632. Alternatively a heated tool may be placed around the exterior of the shell 632 to activate the adhesive; however, this is likely to be less efficient due to the thermal insulating properties of the cardboard shell 632. Once the lining 634 has adhered to the shell 632, the heated tool is withdrawn 774.

An upper section 663 of the bag 652, which protrudes from the opening 643 of the shell 632, is rolled or folded 776 over the top edge of the shell 632 so that the upper section 663 of the bag 652 surrounds an exterior surface of an upper region 688 of the shell 632 around the opening 643. Heating means are then used to shrink 778 the upper section 663 of the bag 652 around the shell 632, as previously described in relation to the cup embodiment. In some embodiments it may be preferable to adhere the upper section 663 of the bag 652 to the exterior surface of the shell 632 using a suitable adhesive, rather than or in addition heat shrinking.

Figure 22:
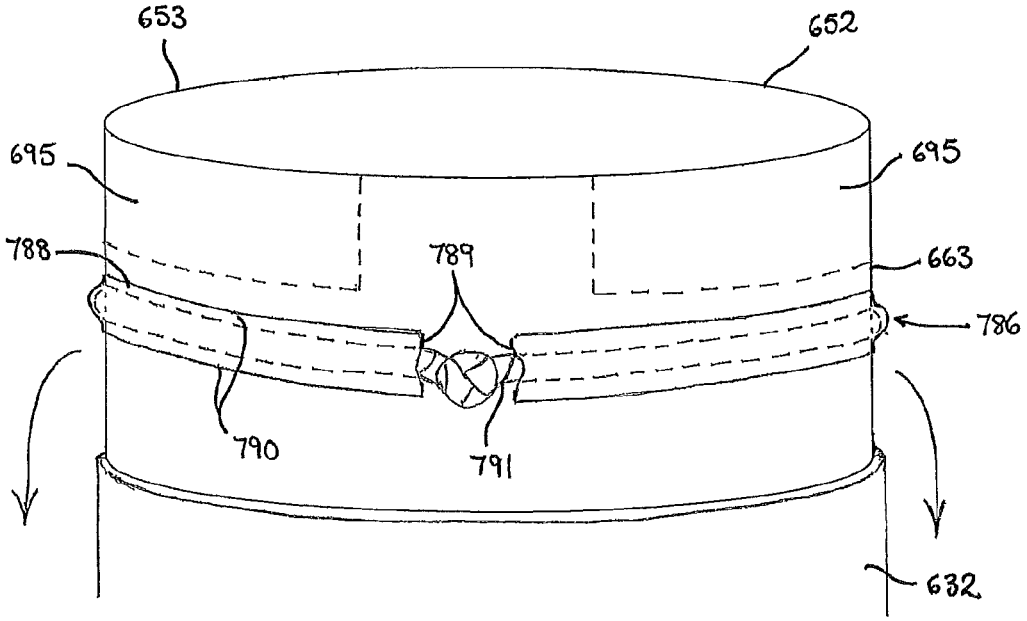
FIG. 22 is a detailed view of one embodiment of an upper region of the bag including a drawstring once it has been inserted into a tubular shell.

FIG. 22 illustrates a preferred embodiment of an upper section 663 of a bag 652 which includes a closure mechanism in the form of a drawstring mechanism 786. A band 788 of a thin-sheet plastics material is bonded to the external surface of the bag 652 at a distance from the free edge 653 of the bag 652. The band 788 extends around the majority of the circumference of the bag 652 so that a gap is left between opposing ends 789 of the band 788. The band 788 is bonded to the bag 652 along its longer edges 790 such that a tubular channel is formed between a central region of the band and the bag 652; the channel having open ends at the ends 789 of the band 788. In alternative embodiments, an edge region of the bag may be folded and sealed to create a suitable channel for receiving a string or cord 791.

A string or cord 791 extends through the channel with the ends of the string 791 extending from the ends of the channel. Preferably the ends of the string 791 are tied together so that a loop of string 791 is formed. In some embodiments the string 791 may be a strip of plastics material, which is bonded together at its ends to form a complete loop.

In addition to the drawstring mechanism 786, the upper section 663 of the bag 652 also includes perforated regions 695 around the free edge 653 of the bag 652.

The perforated regions 695 are substantially the same as the perforated regions discussed earlier in relation to the cup embodiment, and as such will not be described further here.

Figure 23:
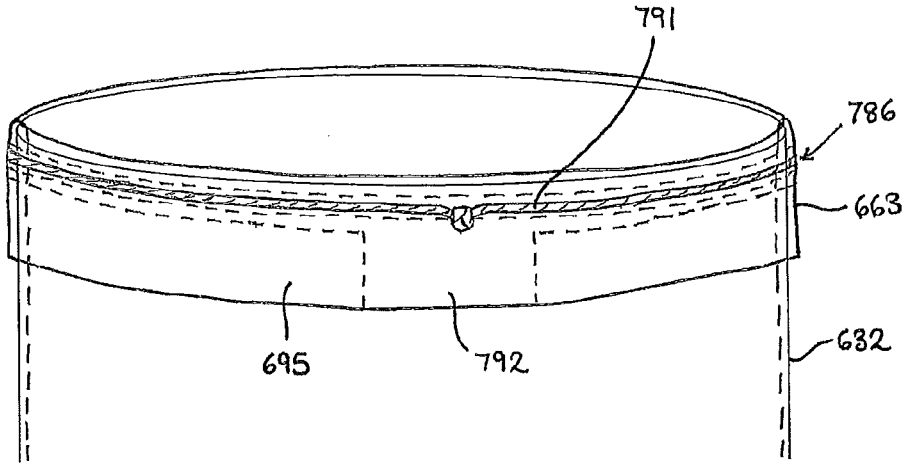
FIG. 23 shows the upper region of the bag of FIG. 22 after it has been folded over the top edge of the tubular shell.

As shown in FIG. 23, when the upper section 663 of the bag 652 is folded over the top edge of the shell 632, the drawstring mechanism 786 is located around the outside of the shell 632 just below the top edge. Overlapping the top edge of the shell 632 with the lining 634 in this way means that, when the container 630 is used as a paint pot, a user of the container 630 can wipe his or her paintbrush on the edge of the container 630 without contaminating the cardboard shell 632 with paint. Additionally, any paint on an inner surface of a lid 740, as described further below, will not contaminate an exterior surface of the shell 632.

Figure 24:
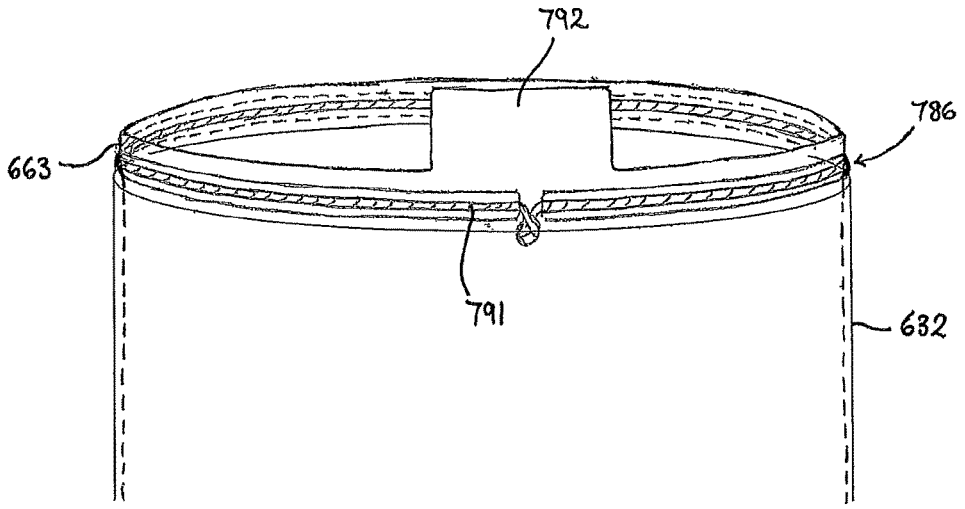
FIG. 24 is a detailed view of an upper portion of the container during removal of the lining bag from the outer shell.

To remove the lining 634 from the shell 632 a user tears the perforated region 695 away from the rest of the container 630. A tab 792, formed by a non-perforated edge portion of the bag 652, can then be lifted to expose the drawstring 786, as shown in FIG. 24.

Figure 25:
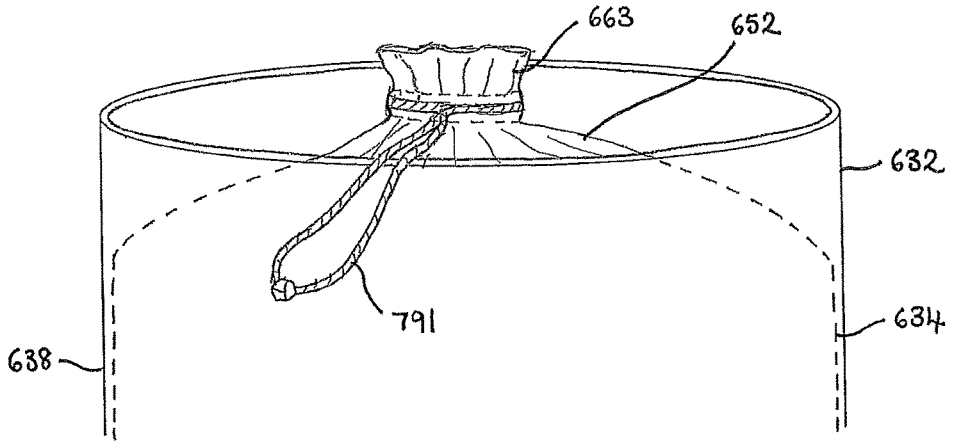
FIG. 25 shows how a drawstring may be used to close a top of the bag during removal of the bag from the outer shell.

The user can pull the tied ends of the string 791 away from the bag 652 so that the upper section 663 of the bag 652 is closed as shown in FIG. 25. Closing the bag 652 in this way means that any residual paint is contained within the bag 652 for ease of disposal.

In closing the bag 652, an upper portion of the side wall of the bag 652, which has been adhered to an upper region of the internal surface of the wall 638 of the shell 632, is pulled inwards away from the wall 638 of the shell 632. The remainder of the lining 634 can then be peeled away from the rest of the internal surfaces of the shell 632 as previously described.

Once the lining 634 has been removed it may be disposed of in a suitable manner depending on its contents. The shell 632, which is 100% cardboard and uncontaminated, can be recycled using conventional methods.

Returning now to FIG. 3, a preferred embodiment of a container 630 includes a lid 740 to cover the opening 643 of the container 630. The lid 740 comprises a circular disc forming a top 793 of the lid 740 and a side wall 794 extending down from the top 793 around the full circumference of the lid 740.

In a similar manner to the main body 738 of the container 630, the lid 740 comprises two layers; an outer shell 632A made from a paperboard material and an inner lining 634A made from a thin-film plastics material. The lid 740 is formed in substantially the same way as the main body 738 of the container 630 and, as such, its manufacture will not be described further. As with the main body 738 of the container 630, when a user wishes to dispose of the lid 740, the lining 634A can be peeled away from the shell 632A so that the lining 634A can be disposed of or recycled separately from the shell 632A.

Figure 26:
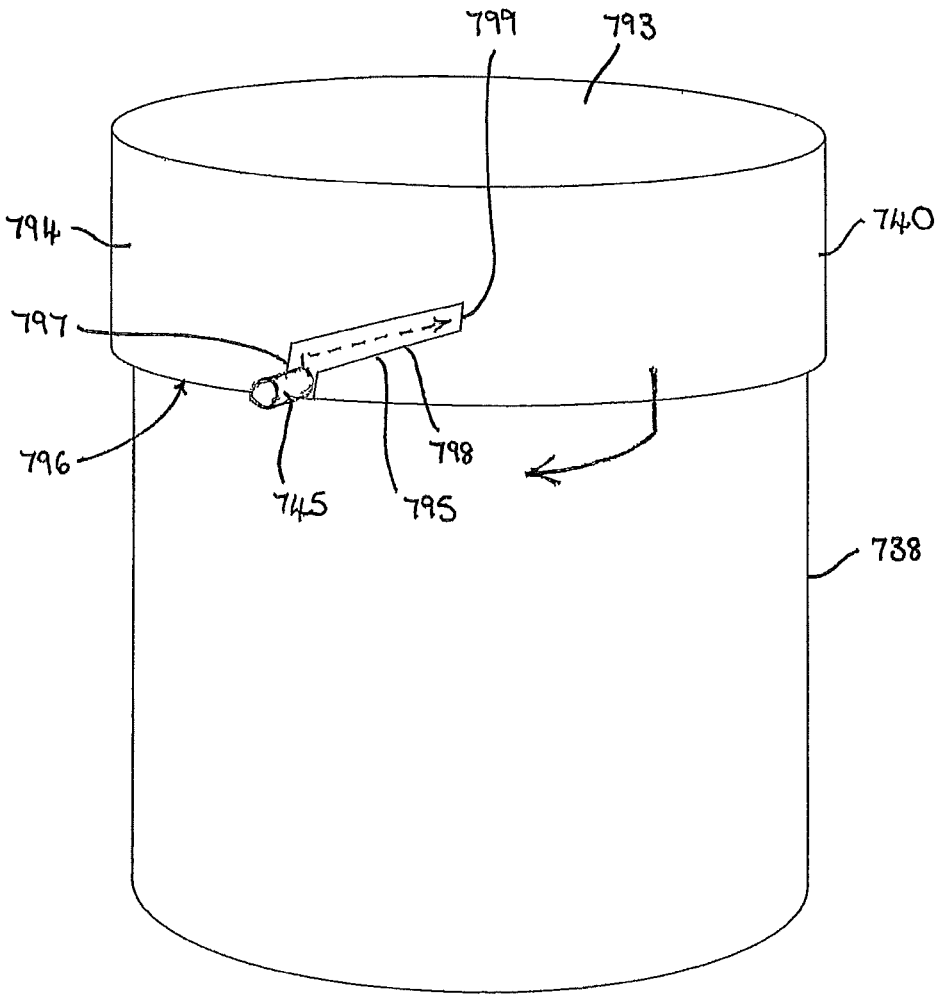
FIG. 26 illustrates one embodiment of a securing means that may be used to secure a lid onto the top of the container.

A preferred means for securing the lid 740 to the main body 738 of the container 630 is shown, in particular, in FIGS. 3 and 26. The securing means 744 comprises at least two pins or pegs 745 projecting outwardly from the side wall 638 of the body 738 of the container 630 and a corresponding two or more slots 795 formed in the side wall 794 of the lid 740 for receiving the pegs 745 as described below.

The pegs 745 extend radially outward from the external surface of the main body 738 of the container 630 in the upper region 688 proximate the top edge. The pegs 745 may be located above or below the edge of the upper section 663 of the lining bag 652. The pegs 745 are preferably made of a metal, such as steel, but may alternatively be made of plastic. If only two pegs 745 are present these are preferably located on opposite sides of the container 630. If more than two pegs 745 are present then the pegs 745 are preferably spaced apart evenly around the circumference of the container 630. Preferably the securing means 744 comprises three or four pegs 745 extending from the container 630.

The corresponding slots 795 in the lid 740 have a width slightly greater than the diameter of the pegs 745. The slots 795 extend from the free edge 796 of the side wall 794 of the lid 740 generally towards the top 793. A first part 797 of the slot 795 extends for a short distance perpendicularly from the free edge 796 towards the top 793, and a second part 798 of the slot 795 extends circumferentially along the side wall 794 at an angle of between 45° and 90° to the first part 797 of the slot 795. Preferably the second part 798 of the slot 795 extends at an angle of less than 90° so that an end 799 of the slot 795 is closer to the top 793 of the lid 740 than the first part 797 of the slot 795.

In this way the pegs 745 and slots 795 form a bayonet fitting to secure the lid 740 to the main body 738 of the container 630.

In use, the lid 740 is lowered over the open end of the main body 738 of the container 630 so that the first part 797 of each slot 795 is aligned with a corresponding peg 745. The lid 740 is initially lowered vertically so that the peg 745 is received within the first part 797 of the slot 795. When the peg 745 reaches the end of the first part 797 of the slot 795, the lid 740 is then twisted so that the peg 745 travels along the second part 798 of the slot 795, to the end 799 of the slot 795, as indicated by the arrows in FIG. 26.

In embodiments in which the end 799 of the slot 795 is closer to the top 793 of the lid 740 than the first part 797 of the slot 795, as the peg 745 travels along the second part 798 of the slot 795, the lid 740 is pulled further down onto the main body 738 of the container 630. This helps to establish a tight seal between the inner surface of the top 798 of the lid 740 and the top edge of the main body 738 of the container 630.

A handle 742 may be attached to the container 630, especially if the container 630 is of larger dimensions, to make the container 630 easier to carry. The handle 742 may be attached to either the lid 740 or the main body 738 of the container 630.

Figure 27:
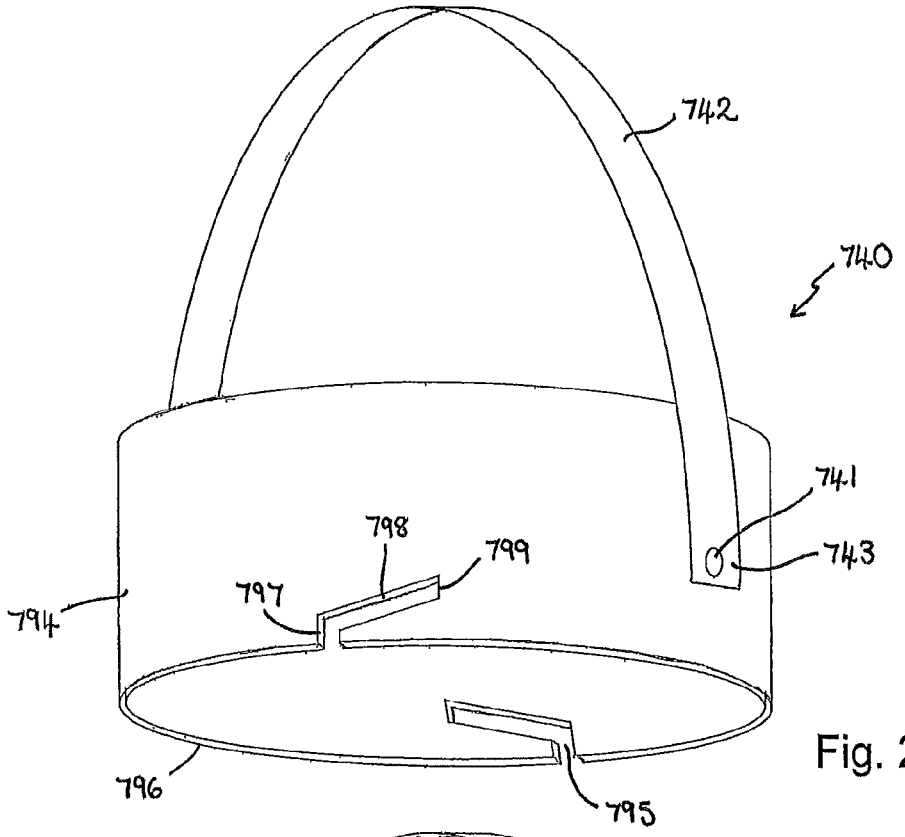
FIG. 27 is a perspective view of one embodiment of a lid incorporating a handle.
Figure 28:
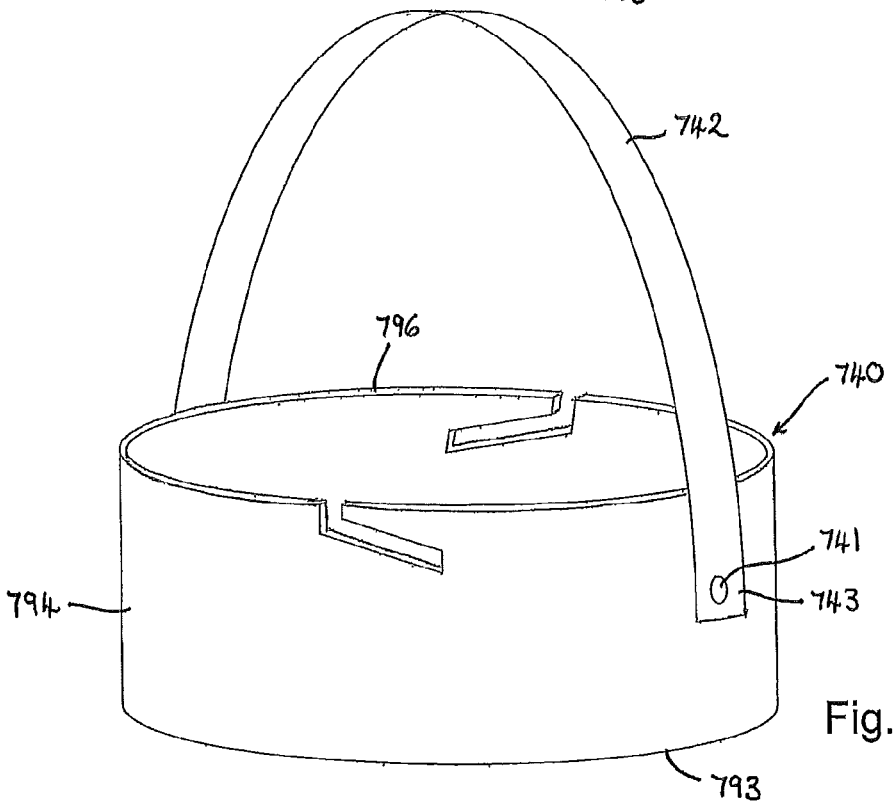
FIG. 28 is a perspective view of the lid of FIG. 27 showing how the handle may be rotated so that the lid may be used as a tray.

FIGS. 27 and 28 show an embodiment in which the handle 742 is attached to the lid 740. The handle 742 is formed from a strip or band of material, which is preferably a plastics material. The handle 742 is attached proximate each of its ends 743 to opposing sides of the lid 740.

Preferably the handle 742 is attached by means of pegs 741 or similar so that the handle 742 is able to pivot about the attachment points.

In a preferred embodiment, the handle 742 is attached proximate its ends 743 such that the handle 742 can rotate about the attachment points through 180°.

In this way, when the lid 740 is removed from the main body 738 of the container 630, the handle 742 can be rotated so that the lid 740 acts as a tray or dish as shown in FIG. 28. In this orientation, the top 793 of the lid 740 becomes a base and the free edge 796 of the side wall 794 is uppermost. The lid 740 may then be used as a tray or dish for containing a volume of paint. This enables a user to carry a volume of paint in the lid 740 when working up a ladder for example rather than needing to carry the whole container of paint.

Because the lid 740 comprises a lining 634A in a similar way to the main body 738, the outer shell 632A of the lid 740 will not be contaminated with paint when used in this way.

Figure 29:
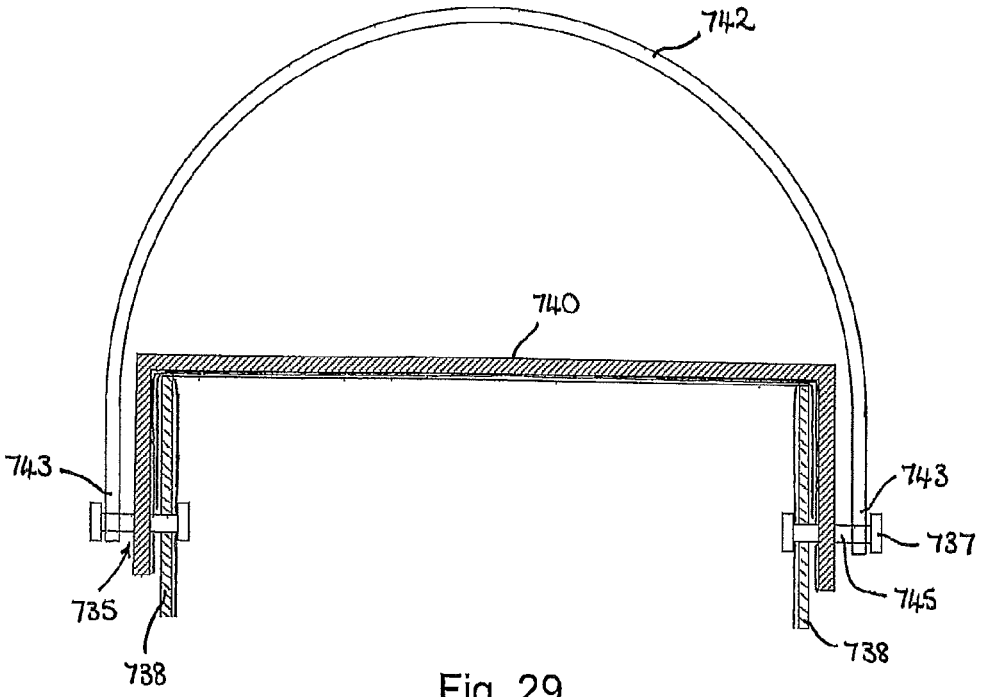
FIG. 29 is a cross-sectional view of an upper portion of a container according to the present invention having a separate lid and handle.
Figure 30:
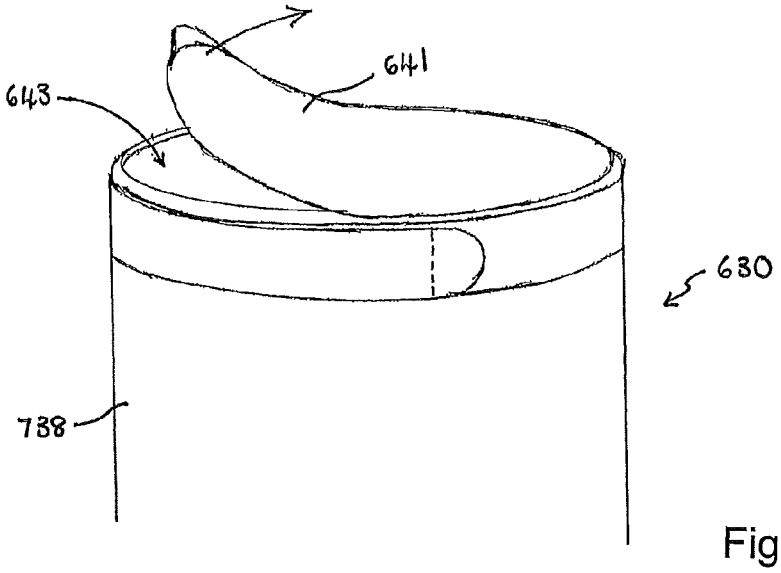
FIG. 30 is a perspective view of a further embodiment of a container according to the present invention in which the container includes a sealing layer.

FIG. 29 shows an embodiment in which the handle 742 is attached to the main body 738 of the container 630. In this example the pegs 745 extending from the main body 738 and forming part of the securing means 744 for the lid 740 protrude further from the external surface of the main body 738 than in the previous example. The handle 742 is attached at end regions 743 of the handle 742 to outer end portions of the pegs 745 so that there is a gap 735 between the end regions 743 of the handle 742 and the main body 738 of the container 630. Capping pieces 737 may be included at the ends of the pegs 745 to retain the handle 742 in position.

The length of the pegs 745 and the gap 735 between the main body 738 of the container 630 and the handle 742 is such that the lid 740 can be received within this gap 735. In particular, central portions of the pegs 745 between the main body 738 and the handle 742 are received in corresponding slots 795 in the lid 740 to secure the lid 740 onto the main body 738 of the container 630 as described above.

When the lid 740 is removed, the handle 742 remains attached to an upper region 688 of the main body 738 via the pegs 745 allowing a user to carry the open container to where it is needed.

In some embodiments it may be preferable to include a sealing layer 641 over the opening 643 of the container 630. This sealing layer 461 is preferably made from a sheet or film of plastics material and is adhered to the main body 738 of the container 630 around its top edge, similar to the sealing layer 441 described earlier in relation to the yoghurt pot embodiment.

The sealing layer 641 completely covers and seals the opening 643 of the container 630 to preserve the contents of the container 630 during initial storage and transportation. When a user first uses the container 630, he or she can peel the sealing layer 641 from the container 630 and dispose of it as appropriate.

Although in the foregoing embodiments some features of the invention have only been described in relation to a particular embodiment, it will be appreciated by a person skilled in the art that features may be combined in further embodiments that are not explicitly described above.

The present invention, therefore, provides a container comprising an inner lining and an outer shell, and a method of making such a container, in which the lining and shell may be peeled apart and disposed of or recycled separately.

The invention claimed is:

1. A method of making a beverage cup having a separable inner lining and outer shell, the method comprising the steps of:

forming an outer shell of the beverage cup, the shell being made from a paperboard material;

pre-forming a flexible lining from a thin sheet of polymeric barrier material, at least a part of the lining conforming to a complete internal shape of the shell, and a thickness of the lining being less than 50 μm;

applying an adhesive to one of an inner surface of the shell and an outer surface of the flexible lining;

inserting the pre-formed lining into the shell so that a first part of the lining is within the shell and a second part of the lining protrudes from an opening of the shell;

adhering the first part of the lining to the internal surface of the shell by the adhesive; and conforming the second part of the lining to an external surface of the shell and heating the second part of the lining such that the second part of the lining shrinks around the outside of the shell, wherein the adhesion between the lining and the internal surface of the shell is such that the lining can subsequently be peeled away from the shell, so that the lining remains intact and no lining remains on the shell, to fully separate the inner lining and outer shell of the cup.

2. A method as claimed in claim 1, wherein the second part of the lining is conformed to the external surface of the shell around the opening and the first part of the lining is preformed in a frustoconical shape.

3. A method as claimed in claim 1, wherein the shell comprises a rolled rim around the opening and the method further comprises, once the lining has been inserted into the shell, the step of folding the second part of the lining over the rolled rim such that the second part of the lining is adjacent the external surface of the shell, and conforming the second part of the lining around the rolled rim.

4. A method as claimed in claim 1, wherein the method further comprises applying an adhesive to a region of the external surface of the shell around the opening, so that the second part of the lining is adhered to the shell in this region.

5. A method as claimed in claim 1, wherein the method further comprises forming perforations in a portion of the second part of the lining.

6. A method as claimed in claim 1, wherein the step of inserting the lining into the shell comprises inserting a male former into the shell, the male former having substantially the same dimensions as the internal dimensions of the shell, so that the lining is pressed against the internal surfaces of the shell.

7. A method as claimed in claim 1, wherein a male former is used to insert the lining into the shell, and the method further comprises the step of blowing the lining away from the male former when the lining is positioned inside the shell.

8. A method as claimed in claim 1, wherein the outer shell is substantially conical or frustoconical.

9. A method as claimed in claim 1, wherein the outer shell is a non-laminated paper cup.

10. A beverage cup having a separable inner lining and outer shell, wherein the beverage cup comprises:

an outer shell made from a paperboard material; and an inner lining, the lining comprising a pre-formed flexible lining of a thin sheet of polymeric barrier material, a thickness of the lining being less than 50 μm, a first part of the lining conforming to a complete internal shape of the shell and being adhered to an internal surface of the shell by an adhesive, and a second part of the lining being heat shrunk around an external surface of the shell, wherein the adhesive adhering the first part of the lining to the internal surface of the shell is such that the lining is peelable from the shell so that the lining remains intact and no lining remains on the shell, such that the inner lining and outer shell of the cup are fully separated.

11. A beverage cup as claimed in claim 10, wherein the outer shell is substantially conical or frustoconical and the pre-formed flexible lining is substantially frustoconical.

12. A beverage cup as claimed in claim 10, wherein the outer shell is a non-laminated paper cup.

13. A beverage cup as claimed in claim 10, wherein the lining is made from an unstretched sheet of plastics material.

14. A beverage cup as claimed in claim 10, wherein the second part of the lining includes perforations.

15. A method as claimed in claim 1, wherein the step of pre-forming a flexible lining from a thin sheet of polymeric barrier material comprises folding a polymeric film along a first edge and then bonding the polymeric film along a second edge, or bonding together two polymeric sheets along both first and second edges.

16. A method of making a beverage cup having a separable inner lining and outer shell, the method comprising the steps of:

forming an outer shell of the cup, the shell being made from a paperboard material;

pre-forming a flexible lining from a thin sheet of polymeric barrier material, at least a part of the lining conforming to a complete internal shape of the shell and the polymeric barrier material having a thickness of less than 50 μm;

applying a heat sensitive adhesive to one of an inner surface of the shell and an outer surface of the flexible lining;

inserting the pre-formed lining into the shell so that a first part of the lining is within the shell and a second part of the lining protrudes from an opening of the shell;

adhering the first part of the lining to the internal surface of the shell by applying heat to the shell and the lining to increase the temperature of the heat sensitive adhesive to cause the adhesive to become tacky and adhere the lining to the internal surface of the shell; and conforming the second part of the lining to an external surface of the shell and heating the second part of the lining such that the second part of the lining shrinks around the outside of the shell, wherein the adhesion between the lining and the internal surface of the shell is such that the lining can subsequently be peeled away from the shell, so that the lining remains intact and no lining remains on the shell, to fully separate the inner lining and outer shell of the cup.

17. A beverage cup as claimed in claim 10, wherein the shell comprises a rolled rim around an opening of the shell.

18. A beverage cup as claimed in claim 17, wherein the second part of the lining conforms closely to the rim of the shell.

19. A beverage cup as claimed in claim 10, wherein the lining includes a bonded seam.

* * * * *